US007415985B2

(12) United States Patent
Nagami

(10) Patent No.: US 7,415,985 B2
(45) Date of Patent: Aug. 26, 2008

(54) SUBSTRATE CLEANING AND DRYING APPARATUS

(75) Inventor: Shuzo Nagami, Kyoto (JP)

(73) Assignee: Dainippon Screen Mfg. Co., Ltd. (JP)

( * ) Notice: Subject to any disclaimer, the term of this patent is extended or adjusted under 35 U.S.C. 154(b) by 628 days.

(21) Appl. No.: 10/947,712

(22) Filed: Sep. 23, 2004

(65) Prior Publication Data

US 2005/0056307 A1 Mar. 17, 2005

(30) Foreign Application Priority Data

Sep. 24, 2003 (JP) ..... 2003-331660
Sep. 24, 2003 (JP) ..... 2003-331661
Sep. 24, 2003 (JP) ..... 2003-331662

(51) Int. Cl.
*B08B 3/02* (2006.01)

(52) U.S. Cl. ..... 134/104.2; 134/184; 134/902

(58) Field of Classification Search ..... 134/104.2, 134/184, 186, 902
See application file for complete search history.

(56) References Cited

U.S. PATENT DOCUMENTS 5,339,539 A 8/1994 Shiraishi et al. ..... 34/58
5,340,437 A * 8/1994 Erk et al. ..... 438/747
5,672,212 A * 9/1997 Manos ..... 134/1.3
5,791,357 A * 8/1998 Hasegawa ..... 134/137
6,182,675 B1 * 2/2001 Naka et al. ..... 134/61
6,286,524 B1 * 9/2001 Okuchi et al. ..... 134/95.2
6,337,030 B1 * 1/2002 Sakaguchi ..... 216/91
6,523,553 B1 * 2/2003 Redeker et al. ..... 134/61
6,669,809 B2 * 12/2003 Hashimoto et al. ..... 156/345.2
6,745,784 B2 * 6/2004 Katakabe et al. ..... 134/153

FOREIGN PATENT DOCUMENTS

JP 4-62831 * 2/1992
JP 10-050657 2/1998
JP 10-199778 * 7/1998
JP 3244220 10/2001

* cited by examiner

*Primary Examiner*—Frankie L. Stinson
(74) *Attorney, Agent, or Firm*—Ostrolenk, Faber, Gerb & Soffen, LLP

(57) ABSTRACT

A substrate cleaning and drying apparatus for performing drying treatment after cleaning treatment of substrates. The apparatus includes a treating tank for storing a treating liquid, and performing the cleaning treatment of the substrates immersed in the treating liquid, a treating chamber housing the treating tank, and having an opening formed in an upper position of the treating chamber for allowing passage of the substrates into and out of the treating chamber, a lid member movable to open and close the opening of the treating chamber, and a holding mechanism for holding the substrates within the treating tank, the holding mechanism having suction bores. After the cleaning treatment of the substrates with the treating liquid in the treating tank, a gas is supplied toward the substrates, with the lid member closed, while suction is effected through the suction bores of the holding mechanism.

9 Claims, 20 Drawing Sheets

21
65
69c
69d
69b
P
71
69a
65
69
67a
67
37a
63
87
exhaust
85
63
25
55
W
61
41
39
43
57
35
43
37
45
47
drain
vacuum source
exhaust/drain
51
53
49
deionized water source
89
88
77
73
79
83
exhaust
dry air source 75

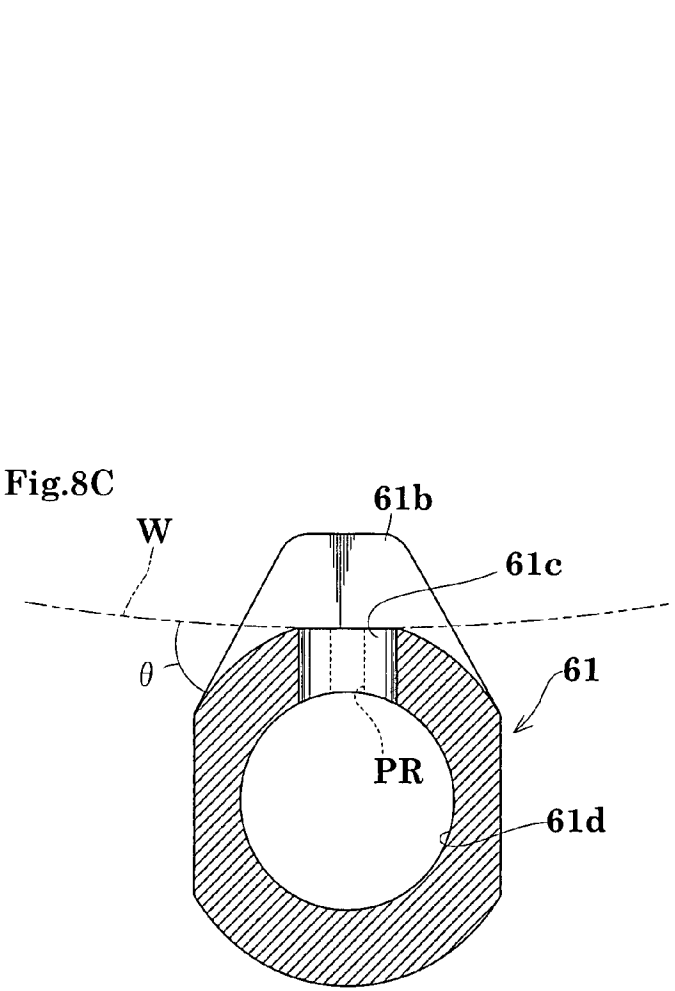
Fig.8C
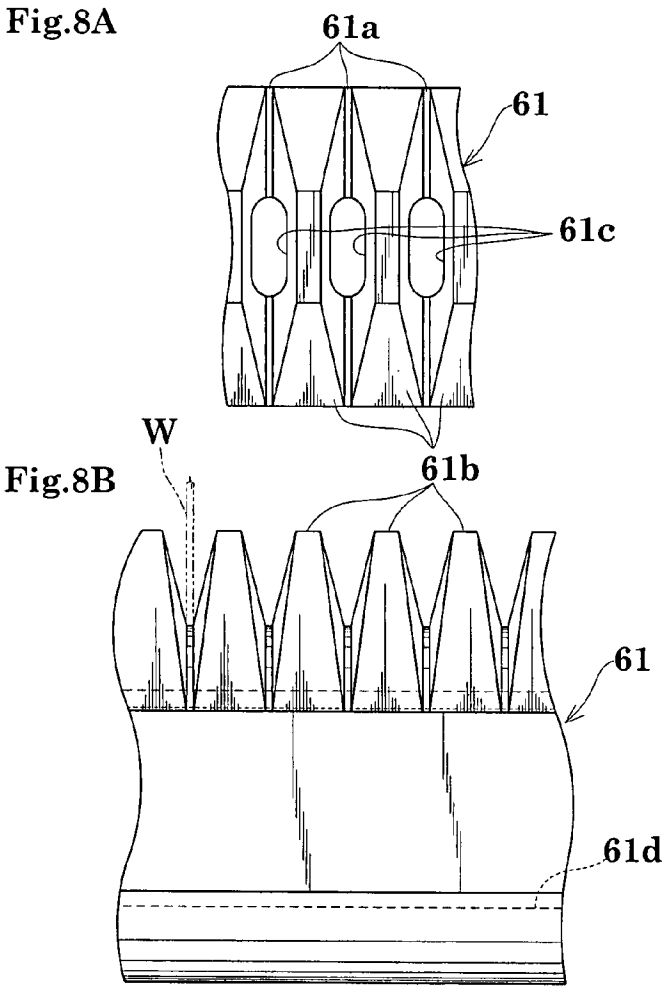
Fig.8A
Fig.8B

SUBSTRATE CLEANING AND DRYING APPARATUS

BACKGROUND OF THE INVENTION (1) Field of the Invention

This invention relates to a substrate cleaning and drying apparatus for cleaning and then drying semiconductor wafers, glass substrates for photomasks, glass substrate for liquid crystal displays, substrates for optical disks or the like (hereinafter called simply substrates). More particularly, the invention relates to a technique for performing drying treatment by suction from a holding device, after cleaning treatment.

(2) Description of the Related Art

Conventionally, this type of apparatus withdraws substrates cleaned in a treating tank up from deionized water stored in the tank, and moves the substrates to a drying device separate from the treating tank. Thereafter, the substrates are dried by air flowing down in a cleanroom while the air is sucked from substrate holders supporting the substrates (see Japanese patent No. 3244220, paragraph No. 0015 and FIG. 3, for example).

The above apparatus is satisfactory for drying hydrophilic substrates having smooth surfaces, such as substrates having oxide film formed thereon or substrates with oxide film, after cleaning treatment with an oxidizer such as a hydrogen peroxide solution.

While the above patent does not give a detailed description regarding the shape of suction bores in the substrate holders, it is understood that a single round bore is formed in each substrate holder as a suction bore. In the light of the level of requirement by semiconductor device makers to date, certain stains (i.e. residues called water marks) are regarded as presenting no serious problem.

The conventional apparatus having such a construction has the following drawbacks:

(1) In a semiconductor device manufacturing process, devices are made from substrates having a complicated three-dimensional configuration. Specifically, the substrates have holes such as contact holes and via holes, groove-like trenches, fins like walls standing close together, and so on. Their surface conditions are diverse from hydrophilic to hydrophobic surfaces. In drying treatment following cleaning of the substrates performed in the course of such device manufacture, the substrates are dried with air taken into a cleanroom as noted above. This drying operation is time-consuming. Deionized water retained by the hydrophilic surfaces could cover the hydrophobic surfaces. Silicon, for example, could dissolve into deionized water remaining on the hydrophobic surfaces. In the gas-liquid-solid interfaces, silicon could be oxidized by the oxygen in the atmosphere.

Further, as the oxidized silicon dissolves into the deionized water, the oxidized silicon and other silicon accumulate in the deionized water. When dried, hydrates of the oxidized silicon, i.e. water marks, are formed to deposit on silicon surfaces. This gives rise to a problem of deteriorating the characteristics of the devices.

Particularly, in cleaning before forming gate oxide film, and cleaning before gate insulation film deposition (CVD), these hydrates of oxidized silicon are electrically insulators and act as resistors. Thus, a normal ohmic contact cannot be obtained, and the structure of the deposited CVD film is distorted by the water marks. This results in defective device characteristics or malfunctioning of the devices per se.

(2) With the recent trend toward larger substrates, a substrate cleaning apparatus, unless designed compact, will pose a serious problem of occupying a large area in a cleanroom. A development has been in progress from a huge apparatus construction in which substrates are linearly moved from one side toward the other side, to a compact apparatus construction having a substrate transport system and an interface only at one side. Where the conventional apparatus noted hereinbefore were employed in combination with such an apparatus, substrates would be transported above the apparatus. Substrate could not be transported during drying treatment of other substrates. Thus, it is practically impossible to employ the conventional apparatus. Even if it were employed, the apparatus, because of low throughput, would fail to demonstrate a satisfactory performance.

Device makers have begun to point out that, with further progress in the technique of semiconductor devices, even minute stains on substrate edges will present a problem in device manufacture. Such stains, for example, accumulate on the substrate transport system, contaminate other substrates, detach from the substrates contaminated in the cleaning apparatus or the like into the cleaning solution or rinse solution to adhere to device surfaces, and ultimately cause device defects.

Each substrate holder in the conventional apparatus defines only one ordinary round bore. Such a construction cannot meet the above requirement.

The above problem arises from a physical positional relationship between the round bore and the substrate holder. That is, a gas flowing into the round bore from right above dries, in a relatively short time, deionized water adhering to a lower edge of the substrate lying over the round bore. However, the drying gas does not flow, in sufficient quantities, down opposite portions outward of the above lower edge, more particularly, arcuate portions obliquely downward from the center of the substrate and portions adjacent positions pinched by the round bore of the substrate holder. Such portions are slow to dry, and stains are formed thereon. These stains, in the case of a silicon substrate, are silicon and oxidized silicon remaining as hydrates of oxidized silicon on substrate surfaces after drying treatment. Silicon dissolves into remaining deionized water, and oxidized silicon is formed in gas-liquid-solid interfaces and dissolves into the remaining deionized water, both accumulating on the substrate surfaces.

SUMMARY OF THE INVENTION

This invention has been made having regard to the state of the art noted above, and its primary object is to provide a substrate cleaning and drying apparatus suitable for obtaining clean substrate surfaces with no water marks or the like formed thereon and no particles adhering thereto. A secondary object of the invention is to provide a substrate cleaning and drying apparatus suitable for a compact construction while employing a mode for drying substrates with a gas supplied from above the substrates.

Another object of the invention is to provide a substrate cleaning and drying apparatus for preventing formation of stains by devising a shape of suction bores to preclude a liquid remaining on substrates.

A further object of the invention is to provide a substrate cleaning and drying apparatus for preventing form ation of stains by effecting suction through a substrate holding device in a dispersed way to preclude a liquid remaining on substrates.

This invention provides a substrate cleaning and drying apparatus for performing drying treatment after cleaning treatment of substrates, the apparatus comprising:

a treating tank for storing a treating liquid, and performing the cleaning treatment of the substrates immersed in the treating liquid;

a treating chamber housing the treating tank, and having an opening formed in an upper position of the treating chamber for allowing passage of the substrates into and out of the treating chamber;

a lid member movable to open and close the opening of the treating chamber; and a holding device for holding the substrates within the treating tank, the holding device having suction bores;

wherein, after the cleaning treatment of the substrates with the treating liquid in the treating tank, a gas is supplied toward the substrates, with the lid member closed, while suction is effected through the suction bores of the holding device.

Since the drying treatment is carried out in the same treating chamber where the cleaning treatment takes place, the drying treatment does not require the substrates to be moved as being exposed to air outside the chamber. In time of drying treatment, the treating chamber may be sealed by closing the upper opening of the chamber with the lid member. Thus, even during the drying treatment, the substrates may be transported in areas above the treating chamber, to perform the drying treatment in a convenient manner even though the apparatus is made compact.

The apparatus according to the invention may further comprise a discharge device for discharging the treating liquid from the treating tank, wherein, after the treating liquid is discharged from the treating tank by the discharge device, the gas is supplied toward the substrates, with the lid member closed, while suction is effected through the suction bores of the holding device.

The treating liquid used in the cleaning treatment is discharged from the treating tank. Then, the drying treatment of the substrates is performed by supplying the gas toward the substrates, with the lid member closed, while effecting suction from the suction bores of the holding device. Thus, a switch may be made quickly from the cleaning treatment to the drying treatment without requiring the substrates to be moved within the treating chamber.

In another aspect of the invention, a substrate cleaning and drying apparatus is provided for performing drying treatment after cleaning treatment of substrates, the apparatus comprising:

a treating tank for storing a treating liquid, and performing the cleaning treatment of the substrates immersed in the treating liquid;

a treating chamber housing the treating tank, and having an opening formed in an upper position of the treating chamber for allowing passage of the substrates into and out of the treating chamber;

a lid member movable to open and close the opening of the treating chamber;

a first holding device for holding the substrates within the treating tank; and a second holding device for transferring the substrates to and from the first holding device, the second holding device having suction bores, and arranged to hold the substrates in a position in the treating chamber above the treating tank;

wherein, after the cleaning treatment of the substrates with the treating liquid in the treating tank, the first holding device transfers the substrates to the second holding device, and a gas is supplied toward the substrates, with the lid member closed, while suction is effected through the suction bores of the second holding device in the position in the treating chamber above the treating tank.

The drying treatment following the cleaning treatment is carried out in the same treating chamber where the cleaning treatment takes place. Thus, the drying treatment does not require the substrates to be moved as being exposed to air outside the chamber. In time of drying treatment, the treating chamber may be sealed by closing the upper opening of the chamber with the lid member. Thus, even during the drying treatment, the substrates may be transported in areas above the treating chamber, to perform the drying treatment in a convenient manner even though the apparatus is made compact.

After the cleaning treatment in the treating tank, the first holding device transfers the substrates to the second holding device, and a gas is supplied toward the substrates, with the lid member closed, while suction is effected through the suction bores of the second holding device in the position in the treating chamber above the treating tank. In time of the transfer of the substrates from the first holding device to the second holding device, some of large droplets adhering to the edges of the substrates can fall off. This allows the subsequent drying treatment to be performed smoothly.

In a further aspect of the invention, a substrate cleaning and drying apparatus is provided for performing drying treatment after cleaning treatment of substrates, the apparatus comprising:

a treating tank for storing a treating liquid, and performing the cleaning treatment of the substrates immersed in the treating liquid;

a treating chamber housing the treating tank, and having an opening formed in an upper position of the treating chamber for allowing passage of the substrates into and out of the treating chamber; and a holding device for holding the substrates in the treating chamber, the holding device having suction bores each enlarged in a direction along a circumference of one of the substrates;

wherein, after the cleaning treatment by the treating tank, the drying treatment is performed by effecting suction through the suction bores of the holding device in the treating chamber.

The drying treatment following the cleaning treatment is carried out in the same treating chamber where the cleaning treatment takes place. Thus, the drying treatment does not require the substrates to be moved as being exposed to air outside the chamber. Further, each suction bore has an enlarged dimension in the direction along the circumference of a substrate. Consequently, suction acts even on portions corresponding to opposite sides of the lowermost edge of the substrate located above the round bore in the prior art (i.e. arcuate portions obliquely downward from the center of the substrate and portions adjacent positions pinched by the suction bore of the substrate holder). The drying gas flows in sufficient quantities down these portions of the substrate. Consequently, such portions are dried quickly enough to prevent the liquid remaining and prevent stains being formed thereon.

In this invention, each suction bore having an enlarged dimension in the direction along the circumference of a substrate may be an elongate bore having a longer diameter thereof extending in the direction along the circumference of the substrate. Each suction bore may include two small bores arranged in the direction along the circumference of the substrate. Alternatively, each suction bore may be a composite bore having a slot elongated in the direction along the circumference of the substrate and joined with a round bore, substantially circular in plan view, to have respective centers thereof substantially coinciding with each other in plan view.

In a different aspect of the invention, a substrate cleaning and drying apparatus for performing drying treatment after cleaning treatment of substrates, the apparatus comprising:

a treating tank for storing a treating liquid, and performing the cleaning treatment of the substrates immersed in the treating liquid;

a treating chamber housing the treating tank, and having an opening formed in an upper position of the treating chamber for allowing passage of the substrates into and out of the treating chamber; and a holding device for holding the substrates in the treating chamber, the holding device having suction bores and a gas permeable porous member laid over the suction bores;

wherein, after the cleaning treatment by the treating tank, the drying treatment is performed by supplying a gas toward the substrates while effecting suction through the suction bores of the holding device in the treating chamber.

The drying treatment following the cleaning treatment is carried out in the same treating chamber where the cleaning treatment takes place. Thus, the drying treatment does not require the substrates to be moved as being exposed to air outside the chamber. Further, since suction is effected from the suction bores through the porous member, water droplets may be sucked also from locations that would retain the droplets in the prior art. The drying air also may be drawn from a wider area spread in the direction along the circumference of the substrate than where air is drawn directly through one suction hole. Thus, the droplets may be sucked not only from the lowermost edge of each substrate located right over the suction bore, but also from arcuate portions at opposite sides of the lowermost edge of the substrate. The gas also may be fully drawn. As a result, the regions at the opposite sides of the lowermost edge of the substrate may also be fully dried in a relatively short time, to avoid stains due to parts of the liquid remaining thereon.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

FIG. 8 is enlarged fragmentary views of a substrate holder, in which FIG. 8A is a plan view, FIG. 8B is a side view, and FIG. 8C is a front view in vertical section;

FIG. 10 is enlarged fragmentary views of a modified substrate holder, in which

FIG. 12 is enlarged fragmentary views of another modified substrate holder, in which

DESCRIPTION OF THE PREFERRED EMBODIMENTS

Preferred embodiments of this invention will be described in detail hereinafter with reference to the drawings.

Embodiment 1

Figure 1:
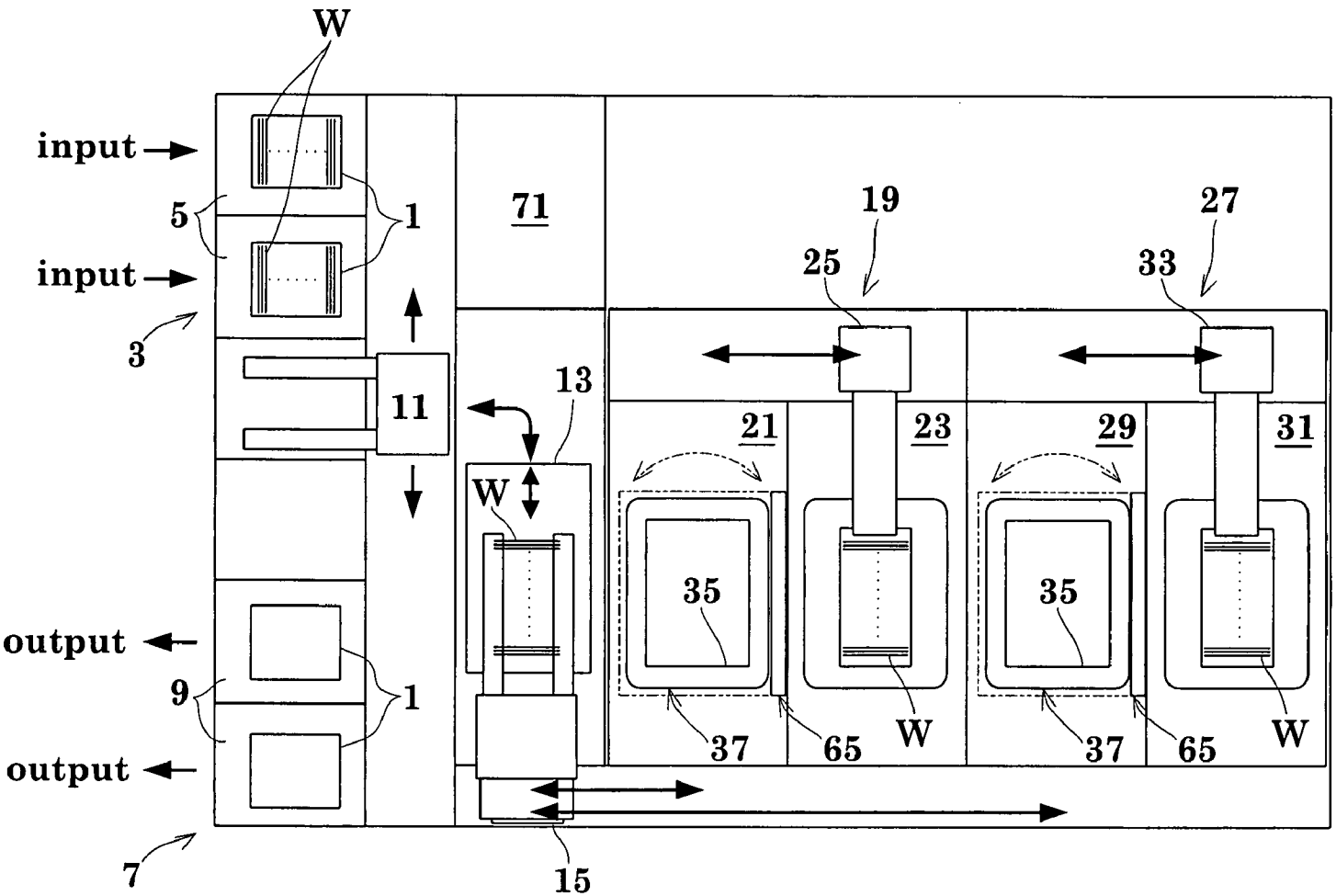
FIG. 1 is a plan view showing an outline of a substrate treating apparatus having cleaning and drying units.

FIG. 1 is a plan view showing an outline of a substrate treating apparatus having cleaning and drying units.

This substrate treating apparatus is, for example, an apparatus for performing chemical treatment, cleaning treatment and drying treatment of wafers W, and has a compact construction to realize a reduced installation area. A plurality of (e.g. 25) wafers W are stored in upstanding posture in each cassette 1. Cassettes 1 containing wafers W to be treated are placed in an input section 3. The input section 3 includes two tables 5 for receiving the cassettes 1 thereon. An output section 7 is disposed opposite the input section 3 across the middle portion of the substrate treating apparatus. The output section 7 stores and delivers treated wafers W in cassettes 1. The output section 7 having this function, as does the input section 3, includes two tables 9 for receiving the cassettes 1 thereon.

A first transport mechanism 11 is disposed in an area extending along the input section 3 and output section 7 to be movable between the two sections 3 and 7. The first transport mechanism 11 transports the plurality of wafers W as stored in each cassette 1 placed in the input section 3, to a second transport mechanism 13.

The second transport mechanism 13 takes all the wafers W out of the cassette 1, and transports these wafers W to a third transport mechanism 15. The second transport mechanism 13 also receives treated wafers W from the third transport mechanism 15, stores these wafers W in a cassette 1 and transports the wafers W and cassette 1 to the first transport mechanism 11.

The third transport mechanism 15 is movable longitudinally of the substrate treating apparatus to transfer wafers W to and from the second transport mechanism 13 described above. A first treating section 19 is disposed in a position upstream with respect to forward movement of the third transport mechanism 15. This first treating section 19 includes a cleaning and drying unit 21 for cleaning and drying a plurality of wafers W, and a chemical treatment unit 23 for giving chemical treatment to the wafers W. The cleaning and drying unit 21 is constructed to perform chemical treatment also.

A first auxiliary transport mechanism 25 transports wafers W within the first treating section 19, and also transfers wafers W to and from the third transport mechanisms 15. The first auxiliary transport mechanism 25 transfers wafers W to and from the third transport mechanisms 15, in a non-treating position over the cleaning and drying unit 21, but not in a non-treating position over the chemical treatment unit 23. For treatment of the wafers W, the first auxiliary transport mechanism 25 descends to a treating position in a tank of the cleaning and drying unit 21 or chemical treatment unit 23.

A second treating section 27 having the same construction as the first treating section 19 is disposed adjacent thereto. The second treating section 27 has a cleaning and drying unit 29, a chemical treatment unit 31 and a second auxiliary transport mechanism 33.

The cleaning and drying units 21 and 29 correspond to the substrate cleaning and drying apparatus in this invention.

Figure 2:
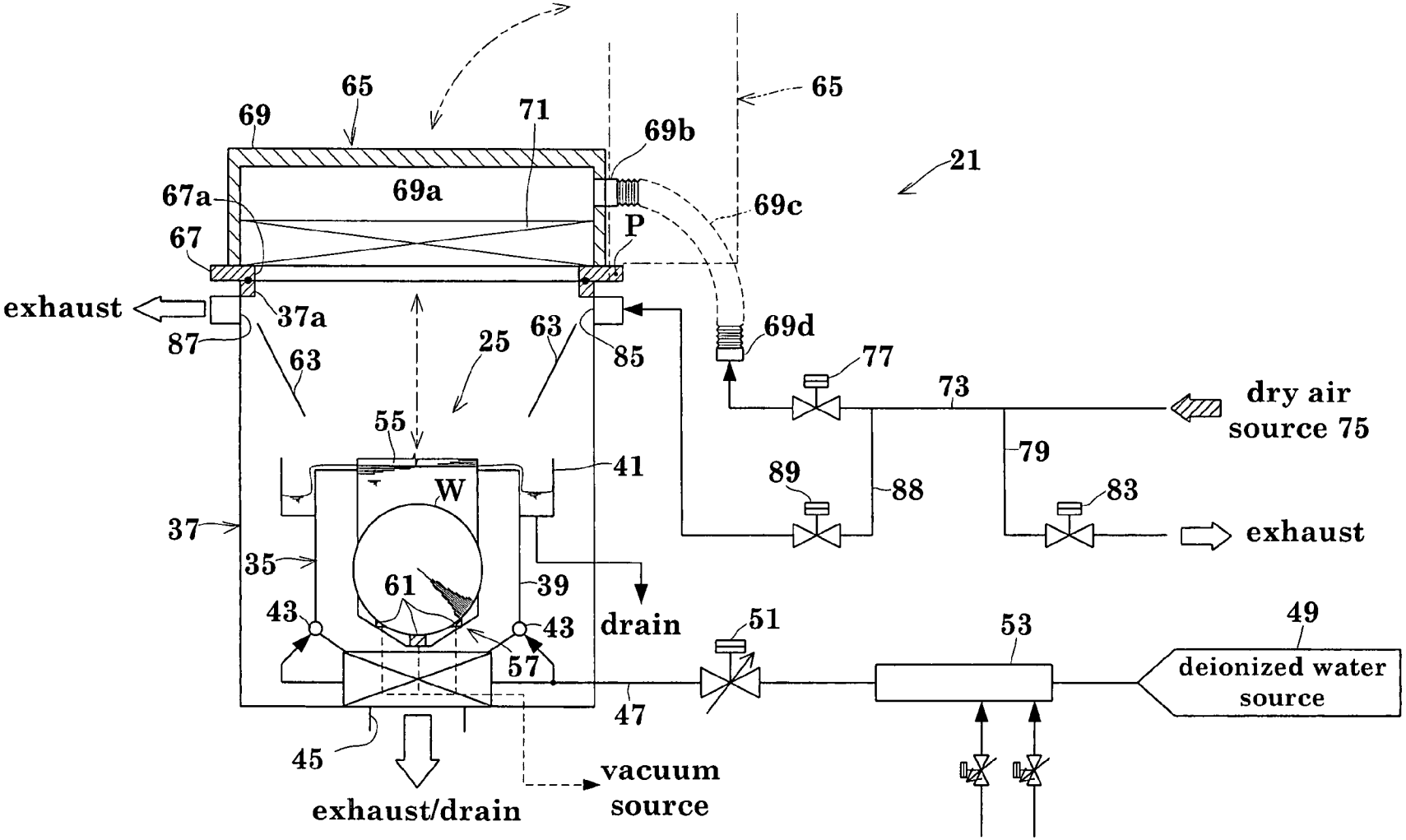
FIG. 2 is a view in vertical section schematically showing a cleaning and drying unit in Embodiment 1.

Next, the cleaning and drying unit 21 will be described with reference to FIG. 2. FIG. 2 is a view in vertical section schematically showing the cleaning and drying unit 21.

The cleaning and drying unit 21 includes a treating tank 35, and a chamber 37 (treating chamber) covering the treating tank 35. The treating tank 35 is a tank for storing a treating liquid for treating wafers W immersed therein. The chamber 37 covers the treating tank 35 with some spaces secured above and around the tank 35, and has an opening 37*a* in an upper position thereof for allowing passage of the wafers W into and out of the chamber 37.

The treating tank 35 includes an inner tank 39 and an outer tank 41. The inner tank 39 has filling pipes 43 arranged at opposite sides in the bottom thereof. The outer tank 41 is disposed so as to surround an upper opening of the inner tank 39, for collecting and discharging the treating liquid overflowing the inner tank 39. The inner tank 39 has a discharge port 45 formed centrally of the bottom thereof to be openable and closable for discharging the treating liquid and gas outside the chamber 37 according to purpose.

In order to exhaust gas smoothly in time of drying treatment described hereinafter, the discharge port 45 may have straightening vanes.

The filling pipes 43 of the treating tank 35 are connected to an end of a treating liquid supply pipe 47. The other end of the pipe 47 is connected to a deionized water source 49. The treating liquid supply pipe 47 has a control valve 51 and a mixing valve 53 mounted thereon in the stated order from the downstream end. The mixing valve 53 is in communication with chemical solution pipes connected to sources of two or more types of chemical solutions, to supply the treating liquid supply pipe 47 with an appropriate chemical solution according to treatment.

The first auxiliary transport mechanism 25 described above has a back plate 55 and a substrate holder 57. The back plate 55 has a plate member which is suspended from the first auxiliary transport mechanism 25, and is vertically movable along inner wall surfaces of the treating tank 39. The substrate holder 57 is attached to the front at the lower end of the back plate 55 to extend horizontally for holding a plurality of wafers W in upstanding posture.

Figure 3:
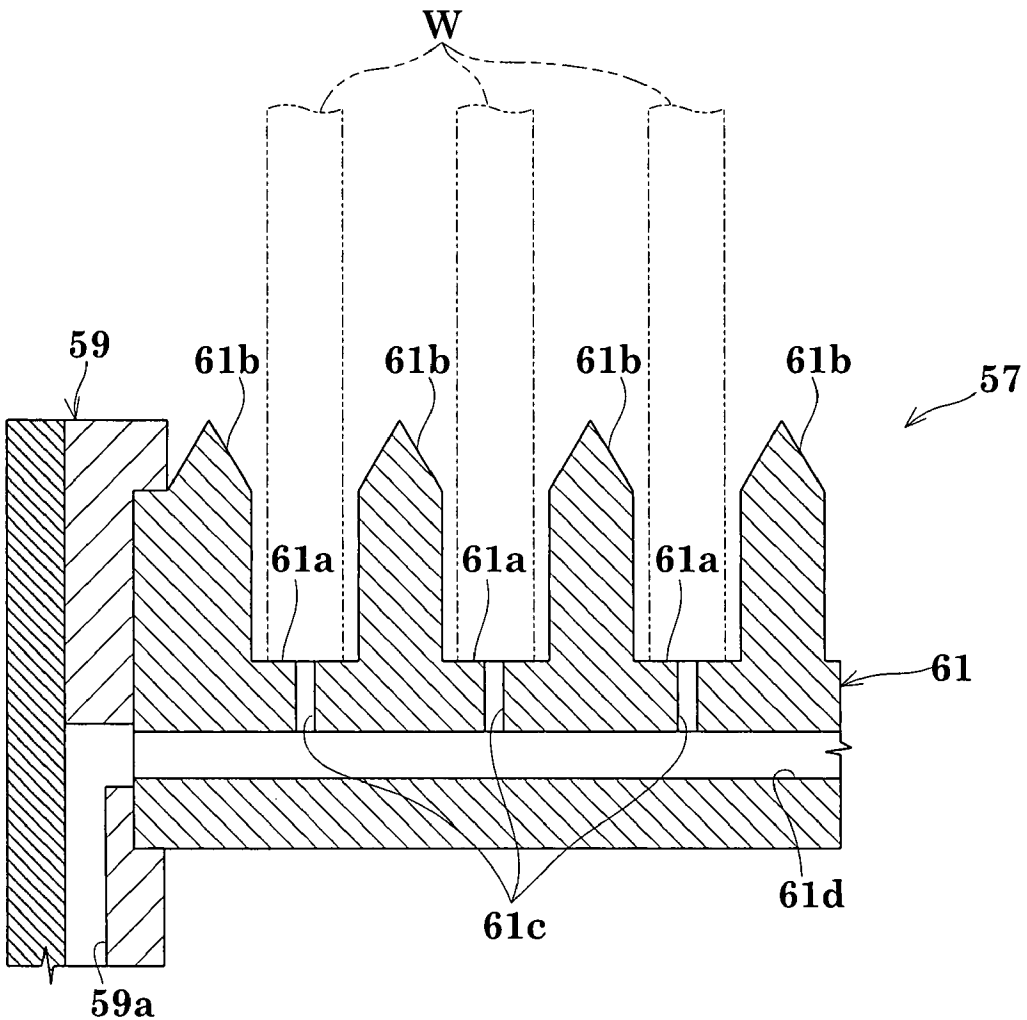
FIG. 3 is an enlarged view in vertical section of a portion of a substrate holder.

FIG. 3 refers. FIG. 3 is an enlarged view in vertical section of a portion of the substrate holder 57.

The substrate holder 57 includes a support member 59 connected to the back plate 55, and three engaging members 61 extending along a direction of arrangement of the wafers W from the support member 59. Each engaging member 61 defines engaging grooves 61*a* having a width slightly larger than the thickness of the wafers W, and projections 61*b* erected between the engaging grooves 61*a* for guiding the wafers W into the engaging grooves 61*a*. In the bottom of each engaging groove 61*a*, a suction bore 61*c* is formed which is smaller than the thickness of the wafers W. Each suction bore 61*c* is in communication with a suction passage 61*d* formed to extend longitudinally of the engaging member 61. A material for forming the engaging members 61 may be PEEK (polyether ether ketone), for example.

The support member 59 is connected to proximal ends of the engaging members 61, and defines a passage 59*a* communicating with the suction passages 61*d*. This passage 59*a* communicates with a vacuum source (not shown) through piping extending outside the treating tank 39 and the chamber 37.

FIG. 2 refers again.

Vertical deflecting plates 63 are arranged at opposite sides below the opening 37*a* of the chamber 37 for reducing an interior volume of the chamber 37, and directing downward currents of drying air as close to the wafers W as possible. Although not shown, the discharge port 45 below the substrate holder 57, preferably, has horizontal straightening vanes for regulating and exhausting air flowing down the inner tank 39.

The cleaning and drying unit 21 has a lid member 65 at the top of the chamber 37. The lid member 65 is pivotable about a horizontal axis P between an open position and a closed position. A contact plate 67 is disposed adjacent the chamber 37, and an opening is formed therein to define a supply port 67*a*. A cover 69 is attached to surround the supply port 67*a*. A filter 71 is mounted in a hollow space 69*a* of the cover 69. The filter 71, preferably, is an ULPA filter or chemical filter, for example. The ULPA filter can remove minute particles. The chemical filter can remove organic matters, anions, cations and so on. A pipe 69*b* is attached to one side of the cover 69 for introducing air into the hollow space 69*a*.

One end of a bellows pipe 69*c* is attached to the pipe 69*b*, while the other end of the bellows pipe 69*c* is connected to piping 69*d*. This piping 69*d* communicates with main piping 73 which is connected to a dry air source 75. A switch valve 77 is mounted on the main piping 73. Between the switch valve 77 and dry air source 75, the main piping 73 branches to an exhaust pipe 79 with a switch valve 83.

The chamber 37 has a supply port 85 and an exhaust port 87 arranged in upper positions thereof below the lid member 65 and at opposite sides across a moving path of wafers W. The supply port 85 communicates with a branch pipe 88 extending from the main piping 73 between the switch valve 77 and branch pipe 79 described above. A switch valve 89 is mounted on the branch pipe 88. When the switch valve 89 is opened, air flows in through the supply port 85, and is exhausted from the chamber 37 through the exhaust port 87.

Figure 4:
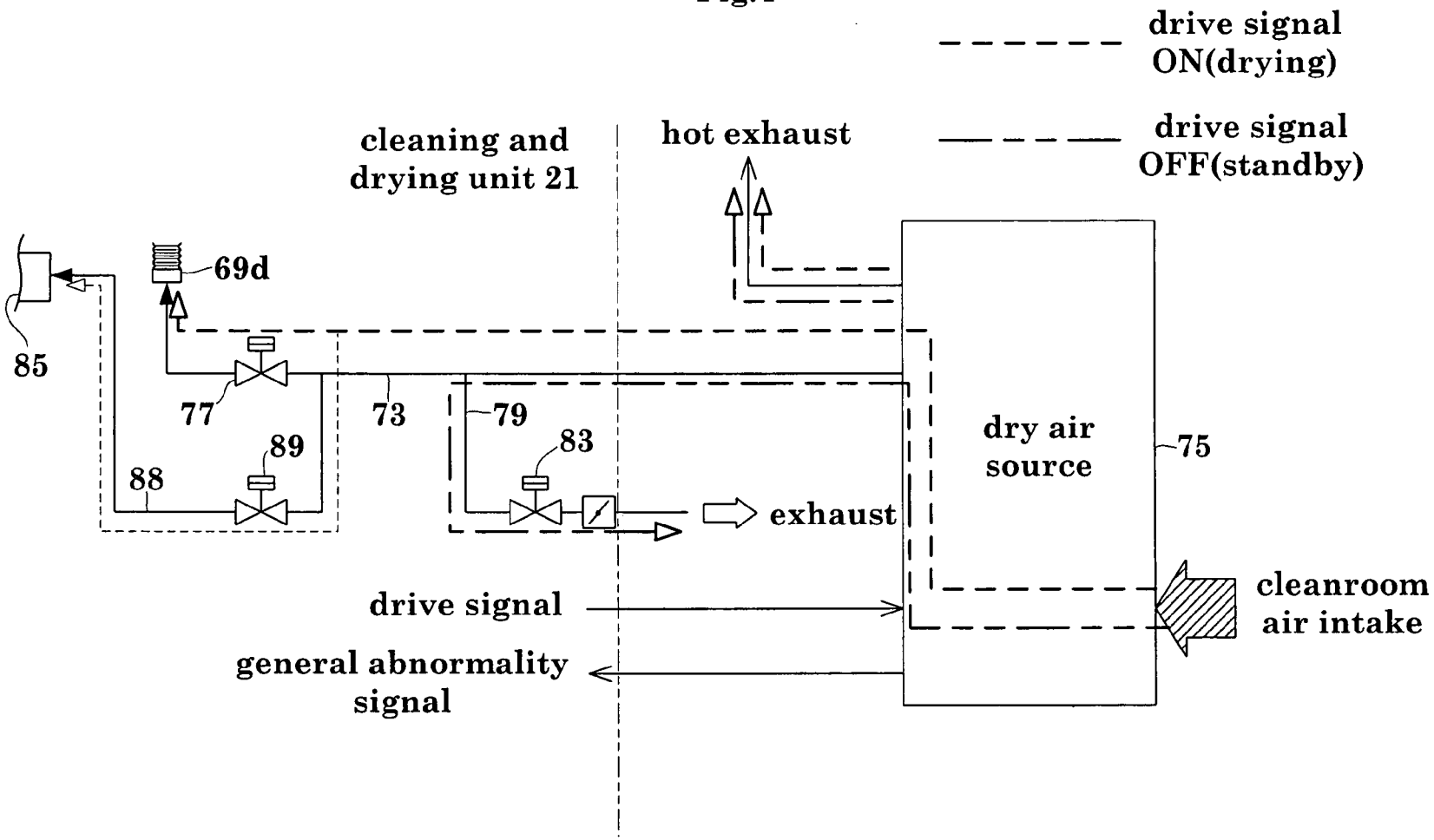
FIG. 4 is an explanatory view of operation of a dry air source.

Next, the dry air source 75 will be described with reference to FIG. 4. FIG. 4 is an explanatory view of operation of the dry air source 75.

The dry air source 75 cooperates with the cleaning and drying unit 21 of the substrate treating apparatus. Specifically, the dry air source 75 is operable in response to a drive signal, and outputs a general abnormality signal to the cleaning and drying unit 21 when an abnormality occurs. The dry air source 75, preferably, produces air at a humidity not exceeding a dew point (e.g. 6 or 7° C. at 40% relative humidity) of the air in the cleanroom, and at a dew point not exceeding −20° C., more desirably not exceeding −60° C. Such air is preferred since a high degree of cleanliness is required particularly for a critical use of semiconductor devices. The critical use signifies drying after pre-cleaning of gate oxide film or gate insulation film deposition (CVD), for example.

When the drive signal is off, i.e. in time of standby, the switch valves 77 and 89 are closed, and the switch valve 83 is opened, whereby dry air is supplied as shown in a two-dot chain line in FIG. 4.

That is, the dry air source 75 draws sucks cleanroom atmosphere, and dehumidifies it to produce dry air and air for regenerating a dehumidification agent. The two types of air are produced in substantially equal quantities. While the dry air is fed to the main piping 73, the air used in regenerating the dehumidification agent and containing moisture is discharged as a hot exhaust (e.g. at 80° C.). The dry air is discharged through the exhaust pipe 79.

In an initial state of the cleaning and drying unit 21, or before an end of cleaning treatment, the switch valve 77 is opened to supply dry air into the chamber 37 through the lid member 65 in the closed position, thereby maintaining the interior of the chamber 37 dry. That is, the following operation similar to an actual drying operation is performed without suction from the suction bores 61*c*.

When the drive signal is ON, i.e. in time of loading or unloading wafers W or in time of drying treatment, the switch valve 77 or switch valve 89 is opened and the switch valve 83 closed. As a result, the dry air having been discharged through the exhaust pipe 79 is now supplied to form an air curtain in the upper position of the chamber 37. The dry air may be supplied also to the wafers W placed on the substrate holder 57.

Figure 5:
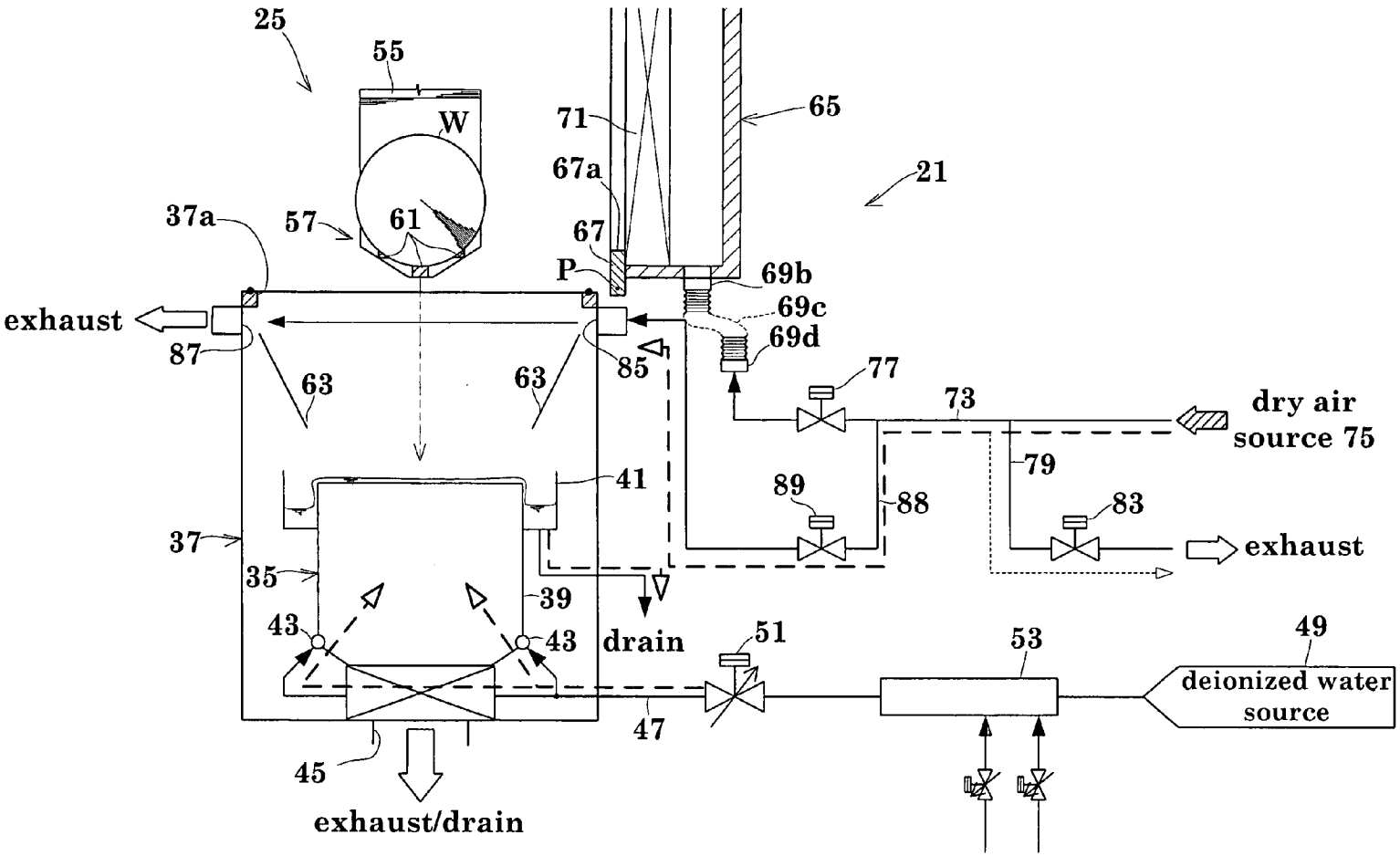
FIG. 5 is an explanatory view of operation in time of loading.
Figure 6:
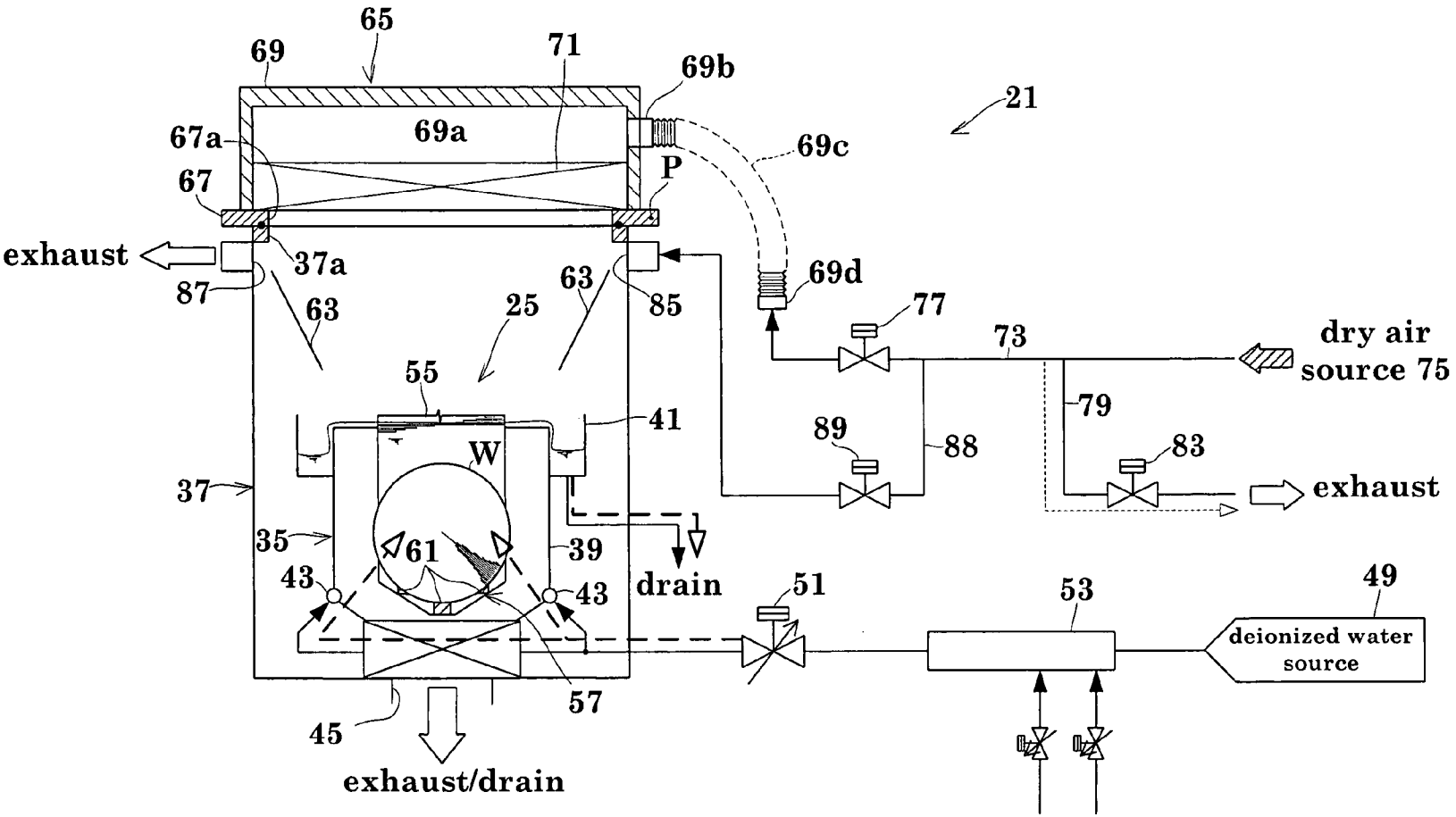
FIG. 6 is an explanatory view of operation in time of cleaning treatment.
Figure 7:
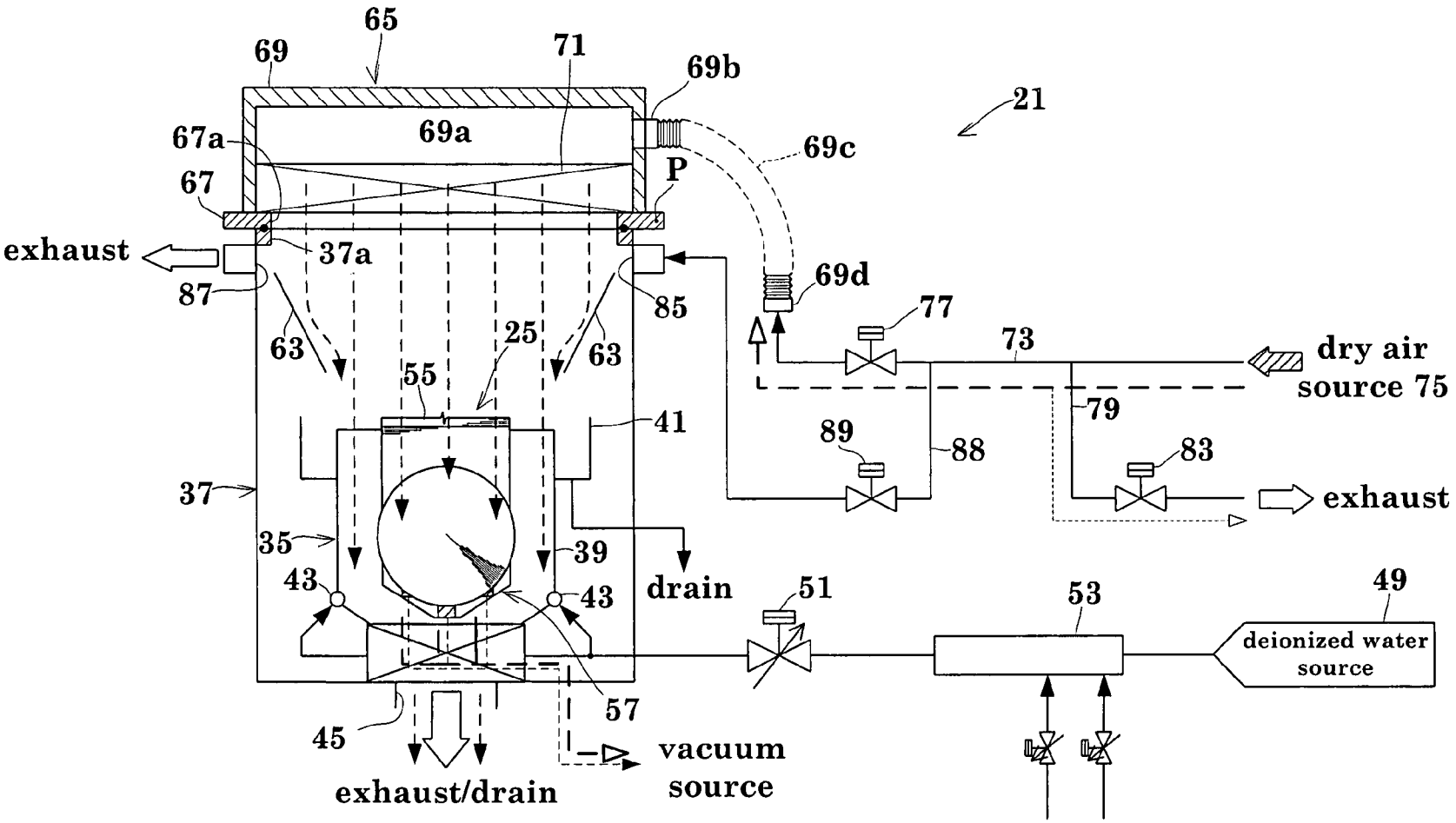
FIG. 7 is an explanatory view of operation in time of drying treatment.

Next, operation of the above cleaning and drying unit 21 will be described with reference to FIGS. 5 through 7. FIG. 5 is an explanatory view of operation in time of loading. FIG. 6 is an explanatory view of operation in time of cleaning treatment. FIG. 7 is an explanatory view of operation in time of drying treatment, It is assumed here, for example, that the first auxiliary transport mechanism 25, as shown in FIG. 5, lies in the non-treating position over the cleaning and drying unit 21 in the first treating section 19 while holding a plurality of wafers W having undergone a predetermined chemical treatment in the chemical treatment unit 23 in the first treating section 19. It is assumed also that the lid member 65 is opened to expose the opening 37*a* of the chamber 37. Substantially at the same time the lid member 37 is opened, the switch valve 83 is closed and the switch valve 89 is opened. As a result, dry air forms an air curtain in the upper position of the chamber 37 to prevent particles and the like generated in time of opening and closing of the lid member 65 and humid gases floating in the cleanroom from flowing into the chamber 37. The following cleaning and drying treatment may therefore be performed in a cleanliness-enhanced condition. In FIG. 5, the lid member 65 opened appears to block movement of the first auxiliary transport mechanism 25 from the chemical treatment unit 23 to the cleaning and drying unit 21. In fact, the first auxiliary transport mechanism 25 has moved the wafers W to the non-treating position through a space over the lid member 65 opened.

It is further assumed that the control valve 51 is opened to supply deionized water at a predetermined flow rate from the deionized water source 49. The deionized water is supplied as a treating liquid to the inner tank 39 of the treating tank 35 through the filling pipes 43. In this example, the treatment in the cleaning and drying unit 29 is only cleaning with the deionized water. It is also possible to mix a chemical into the deionized water through the mixing valve 53, to perform treatment with a treating solution containing the chemical before the cleaning treatment with deionized water.

The first auxiliary transport mechanism 25 having received the wafers W, as shown in FIGS. 5 and 6, moves these wafers W through the air curtain into the treating tank 35 in the cleaning and drying unit 21. Specifically, the first auxiliary transport mechanism 25 lowers the wafers W to the treating position in the inner tank 39, and maintains the wafers W in the treating position as shown in FIG. 6. When the wafers W have reached the treating position, the lid member 65 is closed to seal the interior of the chamber 37. Once the lid member 65 is closed, the control valves 77 and 89 are closed and the control valve 83 is opened to stop the dry air supply into the chamber 37. This state is maintained for a predetermined time, and cleaning treatment is performed for the wafers W.

Upon lapse of the predetermined time, the control valve 51 is closed to stop the supply of the treating liquid to the treating tank 35, and the discharge port 45 is opened. As a result, the treating liquid stored in the inner tank 39 is discharged to complete the cleaning treatment of the wafers W.

Upon completion of the discharge of the cleaning liquid, the control valve 77 is opened, and the vacuum source is actuated to start suction through the substrate holder 57. Then, as shown in FIG. 7, clean dry air is supplied downward from the undersurface of the lid member 65 to dry the wafers W. The dry air flows down along the vertical deflecting plates 63, and down around the wafers W through the inner tank 39 to be discharged from the discharge port 45. Consequently, the wafers W are dried quickly and completely in a short time of about tens of seconds (e.g. less than 30 seconds) by combination of an evaporation effect of the dry air supplied from the undersurface of the lid member 65 and a suction effect through the suction bores 61*c* of the substrate holder 57.

After performing the above drying treatment for a predetermined time, the control valve 77 is closed, the control valve 89 is opened, and the lid member 65 is opened. The first auxiliary transport mechanism 25 is operated to move the substrate holder 57 from the treating position to the non-treating position. Then, the wafers W having received the cleaning and drying treatment are transferred from the first auxiliary transport mechanism 25 to the third transport mechanism 15. Subsequently, the second transport mechanism 13 and the first transport mechanism 11 transport the wafers W, and the cassette 1 storing the wafers W is placed on one of the tables 9.

Since the drying treatment is carried out in the same chamber 37 where the cleaning treatment takes place, the drying treatment does not require the wafers W to be moved as being exposed to the air outside the chamber 37. In time of drying treatment after the cleaning treatment by the treating tank 35, the chamber 37 may be sealed by closing the upper opening 37*a* of the chamber 37 with the lid member 65. Thus, even during the drying treatment, other wafers W may be transported in areas above the chamber 37, to perform the drying treatment in a convenient manner.

In Embodiment 1 described above, the treating liquid used in the cleaning treatment is discharged from the treating tank 35, and then the drying treatment is performed while effecting suction from the suction bores 61*c*. Thus, a switch to the drying treatment may be made quickly without requiring the wafers W to be moved vertically. In this respect, this embodiment has an advantage over Embodiment 2 described hereinafter.

In the above treatment, suction from the suction bores 61*c* is effected while the substrate holder 57 is maintained in the treating position inside the treating tank 35. Instead, drying treatment may be carried out by suction through the suction bores 61*c* and dry air supply from the undersurface of the lid member 65, with the substrate holder 57 raised above the treating tank 35 and without discharging the treating liquid from the treating tank 35.

Further, the treating tank 35 may include a fixed holder disposed therein separately from the vertically movable substrate holder 57, with suction effected through the fixed holder after discharging the treating liquid. Thus, the substrate holder 57 may be used exclusively for substrate transport.

Next, an embodiment of the substrate holder 57 in the above cleaning and drying unit 21 will be described with reference to FIG. 8. FIG. 8 is enlarged fragmentary views of the substrate holder 57, in which FIG. 8A is a plan view, FIG. 8B is a side view, and FIG. 8C is a front view in vertical section.

Each engaging member 61 has a plurality of projections 61*b* arranged at intervals (i.e. intervals for supporting wafers W) defining the engaging grooves 61*a* having a width slightly larger than the thickness of the wafers W. As shown in FIG. 8B, for example, the projections 61*b* present a series of triangular serrations extending in the direction of arrangement of the wafers W, with sloped surfaces thereof serving to guide the wafers W into the engaging grooves 61*a*. The suction bores 61*c* are formed in the engaging grooves 61*a*. As shown in FIG. 8A, each suction bore 61*c* is elongated in a direction along the circumference of wafer W, and is in communication with the suction passage 61*d* formed longitudinally of the engaging member 61.

The shorter diameter of each suction bore 61*c* corresponds to the diameter of the round bore in the conventional construction. The above suction passage 61*d* is in communication with the vacuum source through the piping extending outside. The projections 61*b* are shown in the drawings as having a different thickness to an actual thickness in the ratio to the engaging grooves 61*a*. Specifically, the actual thickness is smaller than is illustrated, so that the engaging grooves 61*a* are arranged closer to one another.

Figure 9:
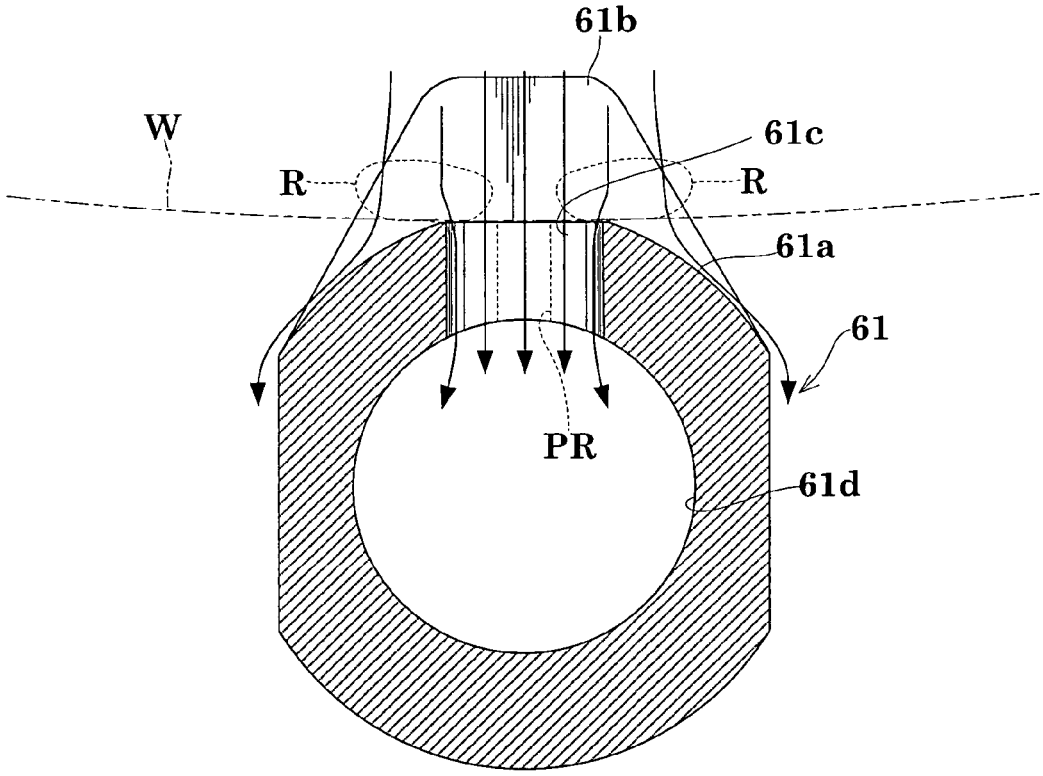
FIG. 9 is an explanatory view of action relating to FIG. 8.

With this construction, as shown in FIG. 9, each suction bore 61*c* is elongated in plan view to have a significantly enlarged dimension in the direction along the circumference of wafer W. In time of drying treatment, therefore, suction acts even on portions at opposite sides (i.e. regions R enclosed in dotted lines in FIG. 9) of the lowermost edge of wafer W, which portions are located obliquely upward from a round bore PR in the conventional construction. According to this invention, the drying gas flows in sufficient quantities down these portions of wafer W. Consequently, such portions are dried quickly enough to prevent the liquid remaining and prevent stains being formed thereon.

In other words, the elongated suction bore 61*c* has outer peripheries thereof located further outward from the center of the engaging member 61 in the circumferential directions of wafer W 61*c* than the peripheries of a simply round bore, for contacting and holding the wafer W. This results in an enlarged angle θ (shown in FIG. 8C) between an upper peripheral surface of the engaging groove 61*a* of the engaging member 61 and a lower arcuate portion of wafer W. Consequently, droplets of the deionized water are hardly retainable in this portion, or droplets retained, if any, will be reduced in size. The enlarged angle θ facilitates flows of the dehumidification air toward the suction bore 61*c*. These two effects promote drying of the wafer W.

Figure 10A:
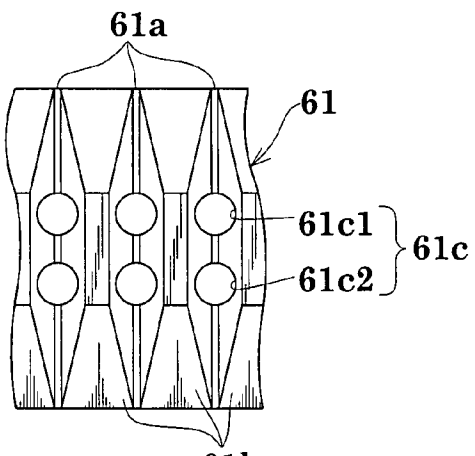
FIG. 10A is a plan view.
Figure 10B:
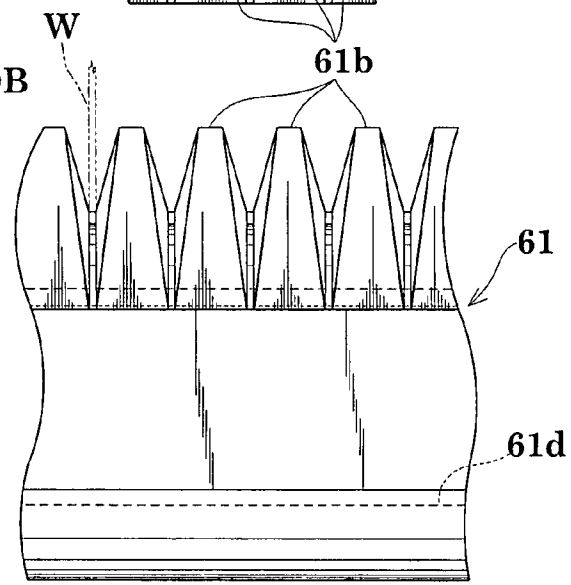
FIG. 10B is a side view.
Figure 10C:
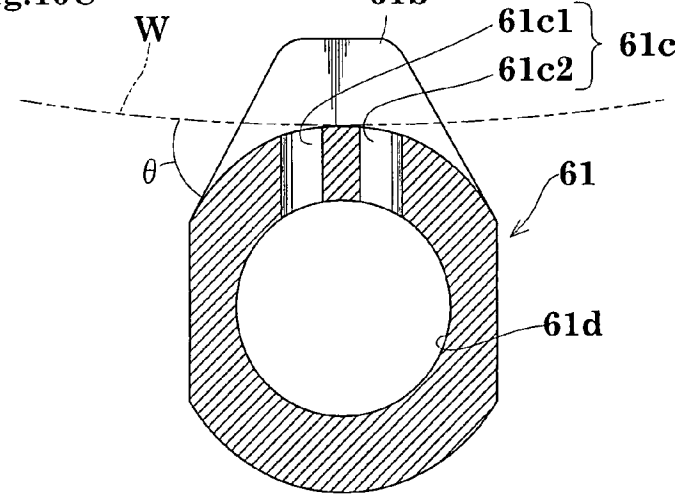
FIG. 10C is a front view in vertical section.

Next, a modified substrate holder 57 will be described with reference to FIG. 10. FIG. 10 is enlarged fragmentary views of the modified substrate holder 57, in which FIG. 10A is a plan view, FIG. 10B is a side view, and FIG. 10C is a front view in vertical section.

Each suction bore 61*c* in this embodiment includes two small bores 61*c*1 and 61*c*2 formed in the direction along the circumference of wafer W. The small bores 61*c*1 and 61*c*2 correspond in diameter to the simply round bore in the conventional construction.

Figure 11:
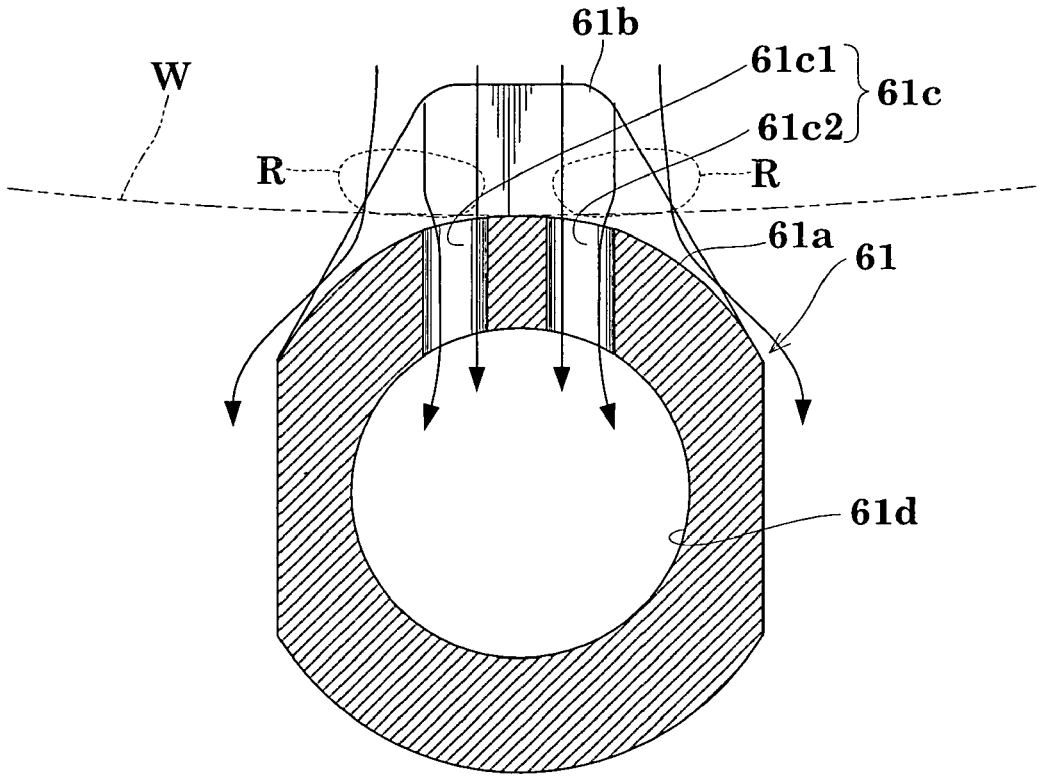
FIG. 11 is an explanatory view of action relating to FIG. 10.

In this case, as shown in FIG. 11, each suction bore 61*c* in substance has an enlarged dimension in the direction along the circumference of wafer W. Consequently, suction acts even on portions at opposite sides (i.e. regions R enclosed in dotted lines in FIG. 11) of the lowermost edge of wafer W, which portions are located obliquely upward from the round bores. The drying gas flows in sufficient quantities down these portions of wafer W. Consequently, such portions are dried quickly enough to prevent the liquid remaining and prevent stains being formed thereon.

In other words, with each suction bore 61*c* including the two small bores 61*c*1 and 61*c*2, the wafer W is contacted and supported by the engaging groove 61*a* between the two small bores 61*c*1 and 61*c*2. Consequently, droplets remaining in this portion are readily dried by the dehumidification air flowing into the small bores 61*c*1 and 61*c*2 at the opposite sides. This construction also results in an enlarged angle θ (shown in FIG. 10C) between an upper peripheral surface of the engaging groove 61*a* of the engaging member 61 and a lower arcuate portion of wafer W. Consequently, droplets of the deionized water are hardly retainable in this portion, or droplets retained, if any, will be reduced in size. The enlarged angle θ facilitates flows of the dehumidification air toward the suction bore 61*c*. These two effects promote drying of the wafer W, compared with the prior art.

This embodiment requires formation of the two small bores 61*c*1 and 61*c*2 corresponding in diameter to the round bore in the prior art. This provides an advantage of easiness of working.

Figure 12A:
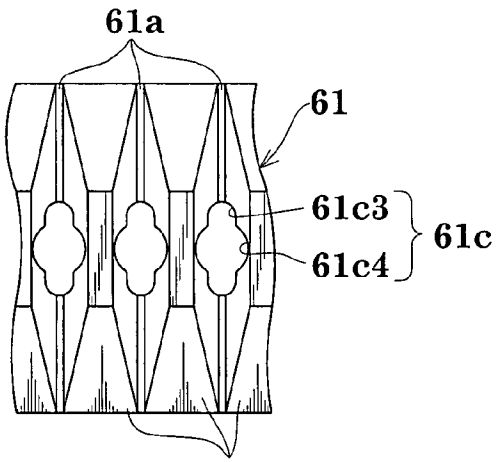
FIG. 12A is a plan view.
Figure 12B:
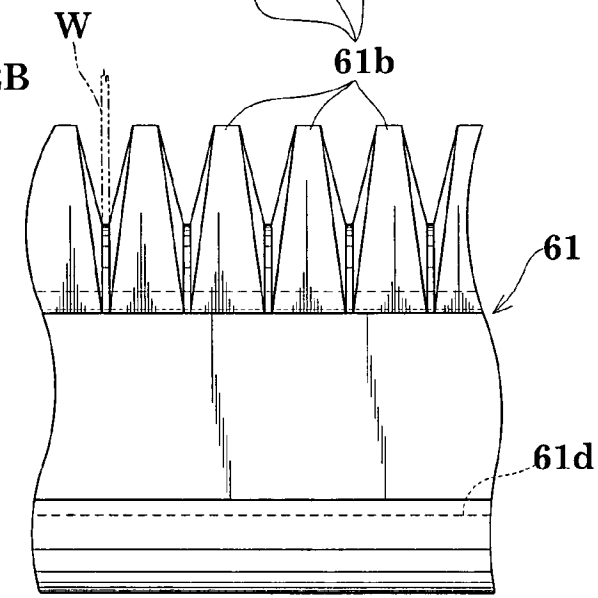
FIG. 12B is a side view.
Figure 12C:
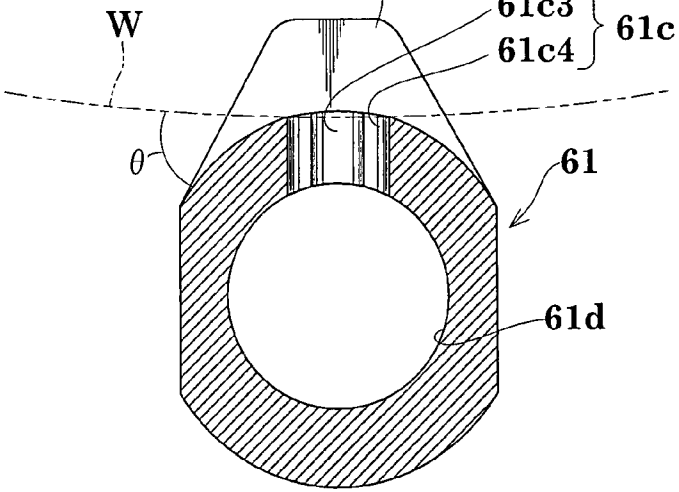
FIG. 12C is a front view in vertical section.

Next, another modified substrate holder 57 will be described with reference to FIG. 12. FIG. 12 is enlarged fragmentary views of this modified substrate holder 57, in which FIG. 12A is a plan view, FIG. 12B is a side view, and FIG. 12C is a front view in vertical section.

Each suction bore 61*c* in this embodiment is in the form of a composite bore having a slot 61*c*3 elongated in the direction along the circumference of wafer W and joined with a round bore 61*c*4, substantially circular in plan view, to have the respective centers substantially coinciding with each other in plan view. The round bore 61*c*4 corresponds in diameter to the simply round bore in the conventional construction.

Figure 13:
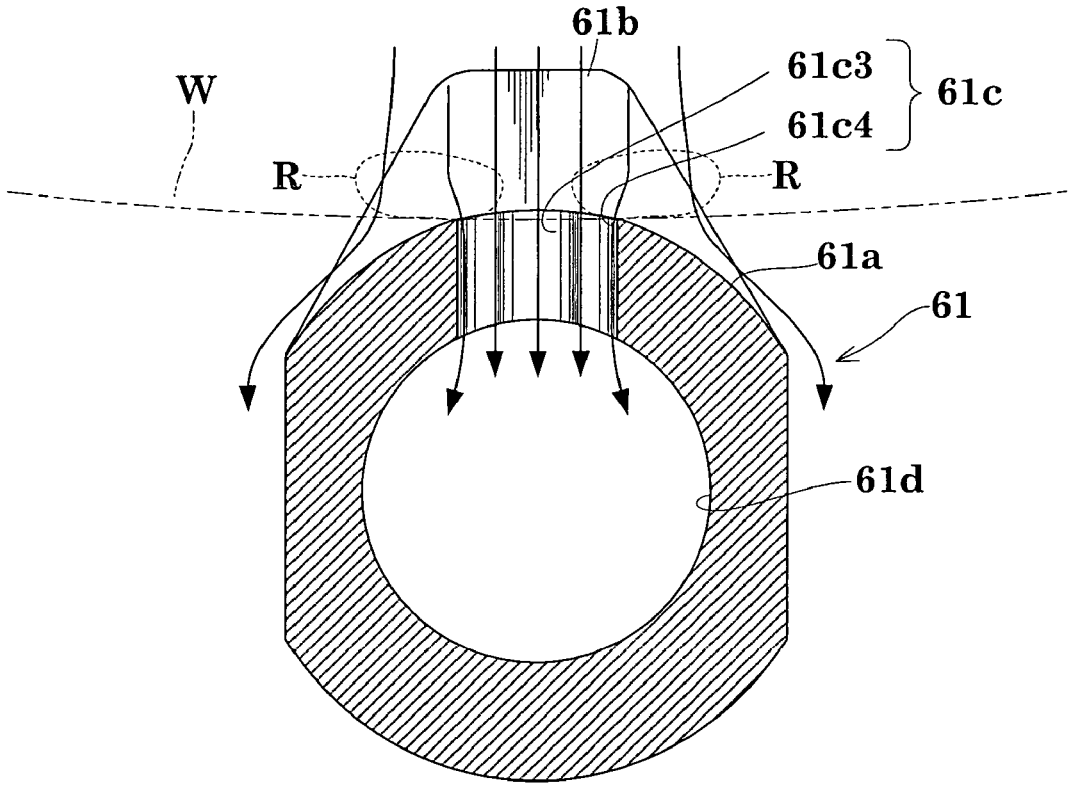
FIG. 13 is an explanatory view of action relating to FIG. 12.

In this case also, as shown in FIG. 13, each suction bore 61*c* is elongated to have a significantly enlarged dimension in the direction along the circumference of wafer W. Suction acts even on regions R enclosed in dotted lines in FIG. 13, and the drying gas flows in sufficient quantities down these regions of wafer W. Consequently, as in the preceding embodiments, this embodiment prevents the liquid remaining and prevents stains being formed thereon.

In other words, the suction bore 61*c* in the form of a composite bore has outer peripheries thereof located further outward from the center of the engaging member 61 in the circumferential directions of wafer W 61*c* than the peripheries of the conventional bore, for contacting and holding the wafer W. This results in an enlarged angle θ (shown in FIG. 12C) between an upper peripheral surface of the engaging groove 61*a* of the engaging member 61 and a lower arcuate portion of wafer W. Consequently, droplets of the deionized water are hardly retainable in this portion, or droplets retained, if any, will be reduced in size. The enlarged angle θ facilitates flows of the dehumidification air toward the suction bore 61*c*. These two effects promote drying of the wafer W, compared with the simply round bore in the prior art.

This embodiment requires the round bore 61*c*4 to be formed after forming the slot 61*c*3. This provides an advantage of easiness of working.

Figure 14:
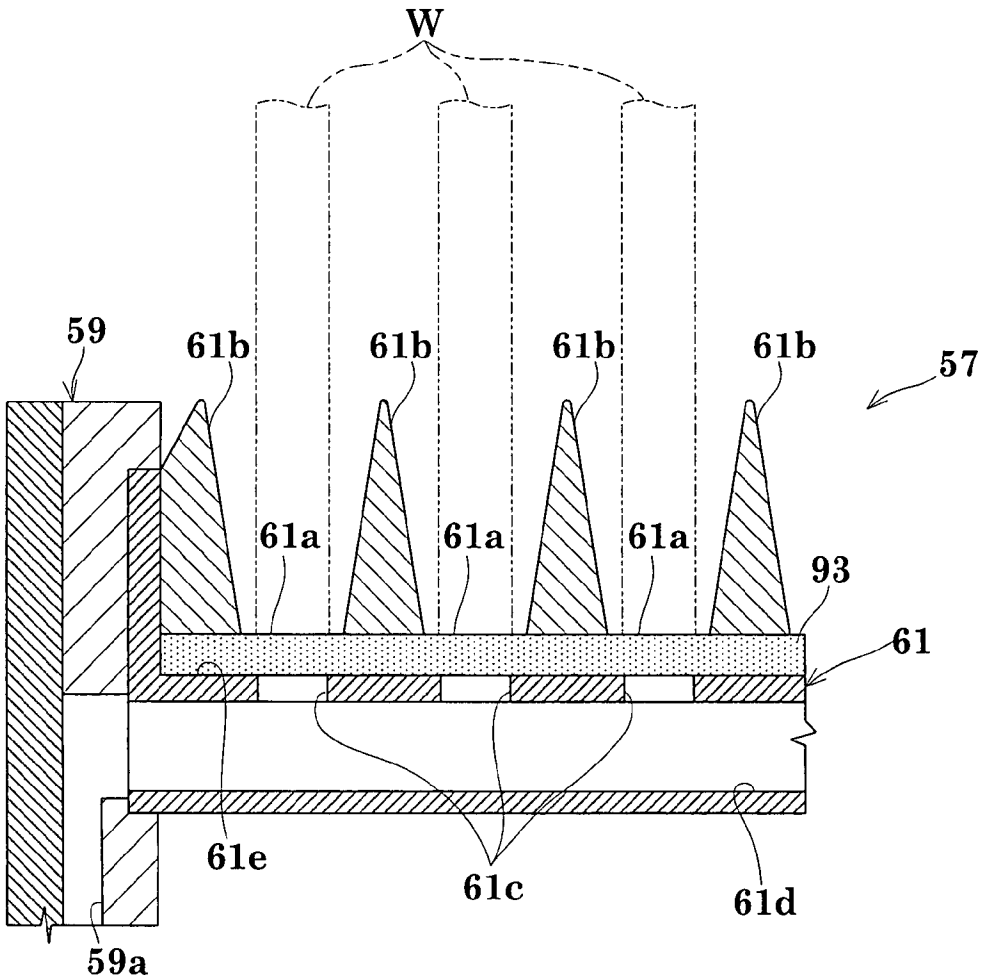
FIG. 14 is an enlarged fragmentary side view in vertical section of a further modified substrate holder.
Figure 15:
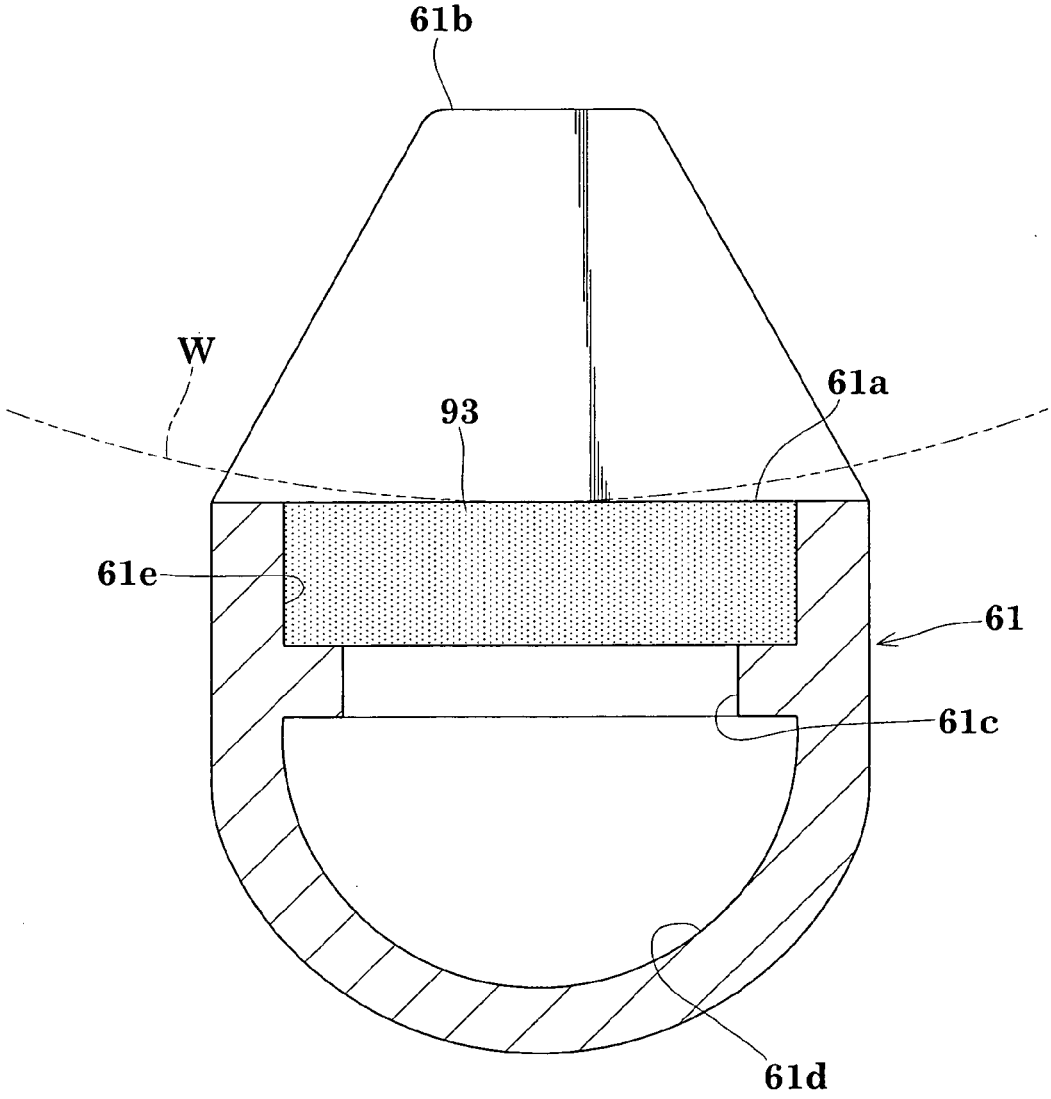
FIG. 15 is an enlarged fragmentary front view in vertical section of the further modified substrate holder.
Figure 16:
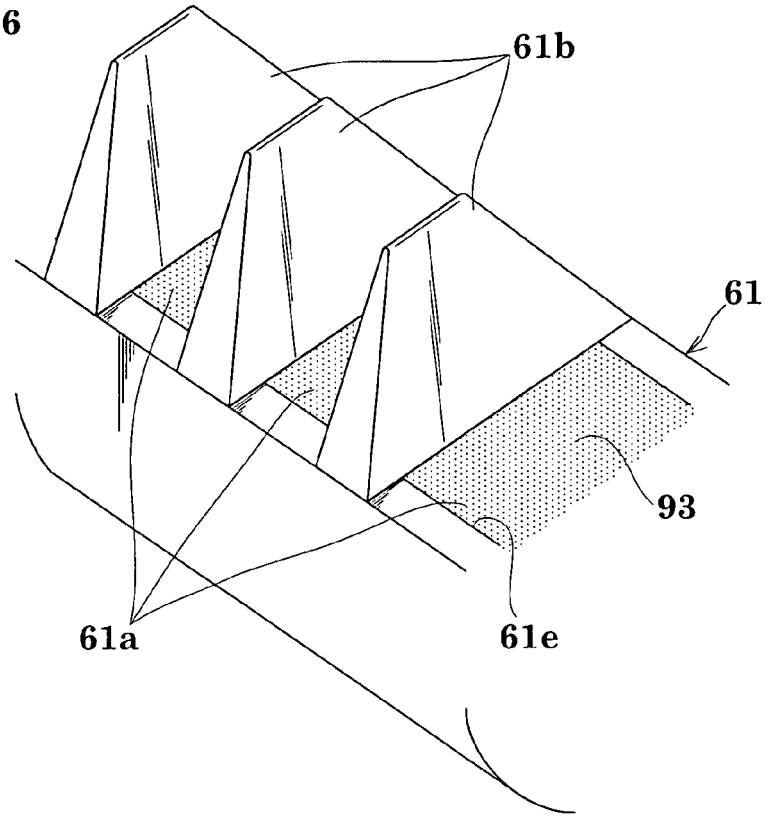
FIG. 16 is an enlarged fragmentary perspective view of the further modified substrate holder.

Next, a further modified substrate holder 57 will be described with reference to FIGS. 14 through 16. FIG. 14 is an enlarged fragmentary side view in vertical section of the further modified substrate holder 57. FIG. 15 is an enlarged fragmentary front view in vertical section of the further modified substrate holder 57. FIG. 16 is an enlarged fragmentary perspective view of the further modified substrate holder 57.

A porous member 93 is laid in an upper position, i.e. a groove 61*e*, of the engaging member 61. With the porous member 93 disposed over the suction bores 61*c*, wafers W do not fit in the suction bores 16*c*. Thus, as shown in FIG. 15. each suction bore 61*c* may be formed longer in the direction along the circumference of wafer W than in the prior art.

It is essential that the porous member 93 herein, in view of its purpose, is what is called the open cell type having gas permeability instead of the closed cell type. The porous member 93 may be formed of porous SiC or a foamed resin (such as foamed polyurethane), for example.

Figure 17:
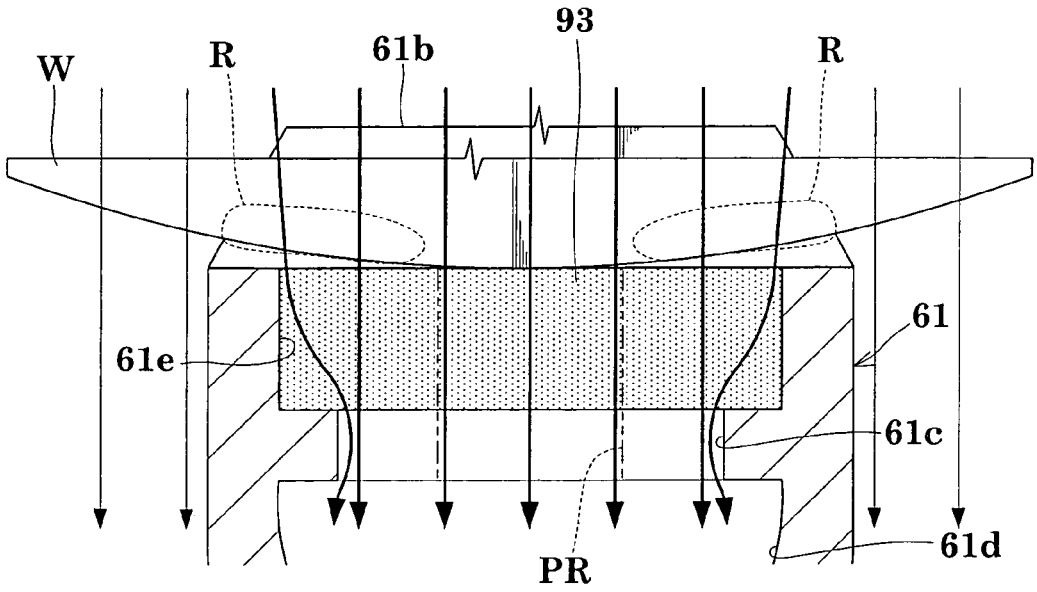
FIG. 17 is a view schematically showing gas flows in time of drying treatment.

With this construction, as shown in FIG. 17, suction is effected through the porous member 93 and through each suction bore 61*c* formed longer in the direction along the circumference of wafer W than the conventional suction bore PR. Thus, droplets may be drawn effectively from where the droplets would remain in the prior art. Further, the dehumidification air may be drawn from a wider area spread in the direction along the circumference of wafer W than in the prior art in which air is drawn directly through the one suction bore PR.

Thus, the droplets may be sucked not only from the lowermost edge of wafer W located right over the suction bore 61*c* but also from arcuate portions at opposite sides (i.e. regions R enclosed in dotted lines in FIG. 17) of the lowermost edge of wafer W. The dehumidification air also may be fully drawn. As a result, the regions R at the opposite sides of the lowermost edge of wafer W may also be fully dried, to avoid stains due to parts of the liquid remaining thereon.

Figure 18:
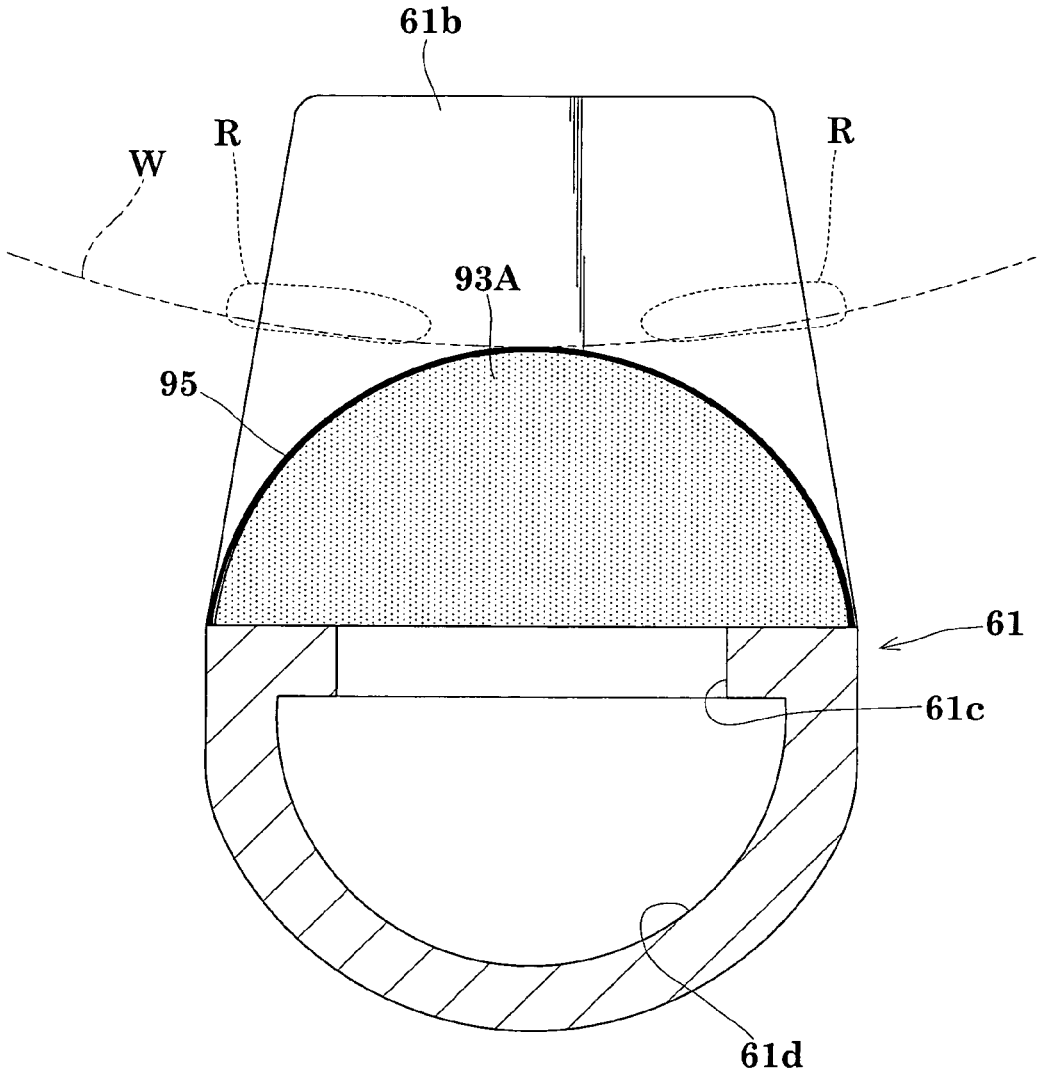
FIG. 18 is a fragmentary front view in vertical section of a further modified substrate holder.

The above substrate holder 57 may be further modified as shown in FIG. 18.

FIG. 18 is a fragmentary front view in vertical section of a further modified substrate holder.

The substrate holder 57 has a porous member 93A laid on each engaging member 61. This porous member 93A is shaped semicircular in vertical section, with a porous film 95 coated on an arcuate upper surface thereof.

The porous member 93A may be formed, for example, of gas permeable SiC, alumina, porous ceramic, sintered quartz, sintered metal or the like. These materials, generally, are harder than the wafers W, and could scratch the edges of wafers W. Such scratches and other damage may be avoided by applying the porous film 95 to the surface of the porous member 93A.

The porous film 95 may, preferably, be formed of an elastic resin or the like that can prevent damage to the wafers W. A specific example is polyimide resin. The porous film 95 is formed, for example, by applying polyimide resin to the upper surface of the porous member 93A, thereafter applying photoresist resin to the polyimide resin to form a porous mask pattern, and then etching the polyimide resin.

Where the porous film 95 is formed by electrodeposition, the resin may be coated on the porous member 93A except the pores. This allows the porous film 95 to be formed with a reduced number of steps.

Also with the construction described above, droplets may be drawn not only from the lowermost edge of wafer W located right over the suction bore 61*c* but also from arcuate portions R at opposite sides (i.e. regions enclosed in dotted lines in FIG. 18) of the lowermost edge of wafer W. The dehumidification air also may be fully drawn. Thus, this construction provides the same functions and effects as the embodiments particularly described hereinbefore. In addition, the porous member 93A, with the upwardly arcuate sectional shape, provides a point contact to realize a reduced area for contacting the lower edge of wafer W, compared with the embodiments described hereinbefore.

Embodiment 2

Figure 19:
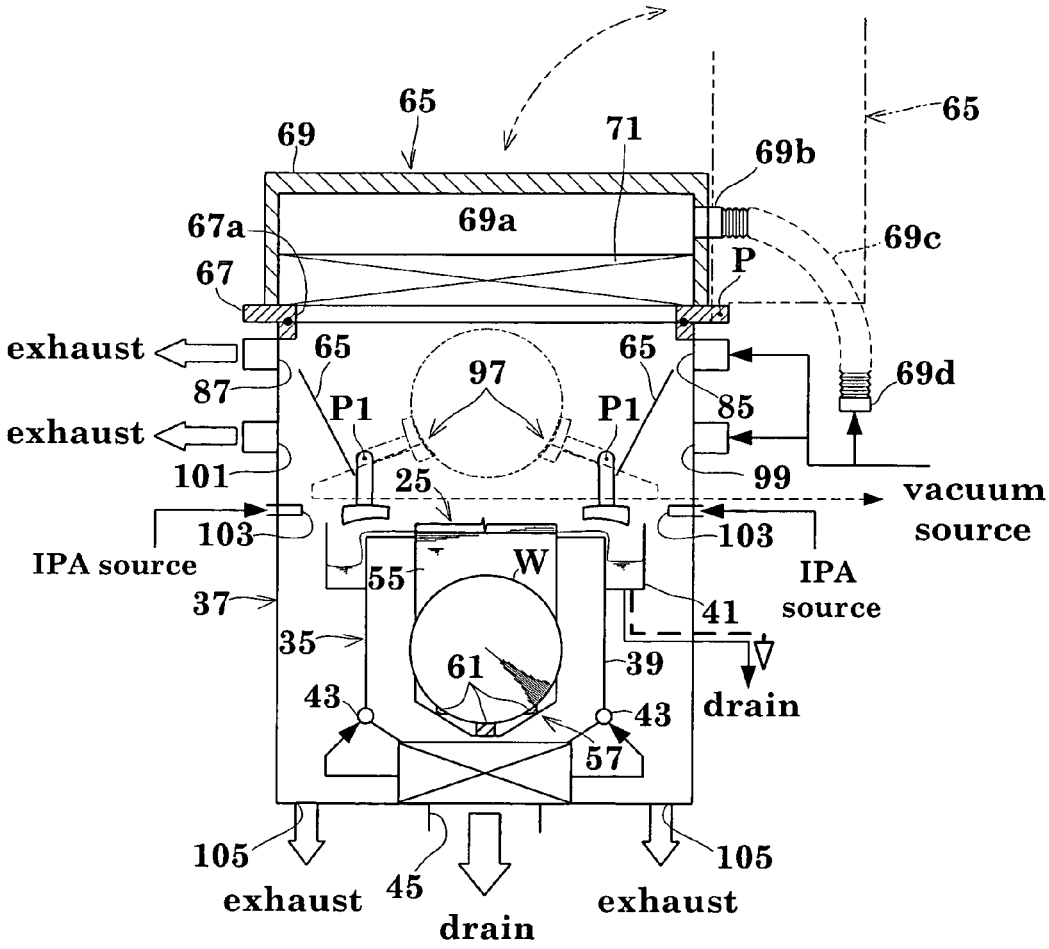
FIG. 19 is a view in vertical section schematically showing a cleaning and drying unit in Embodiment 2.
Figure 20:
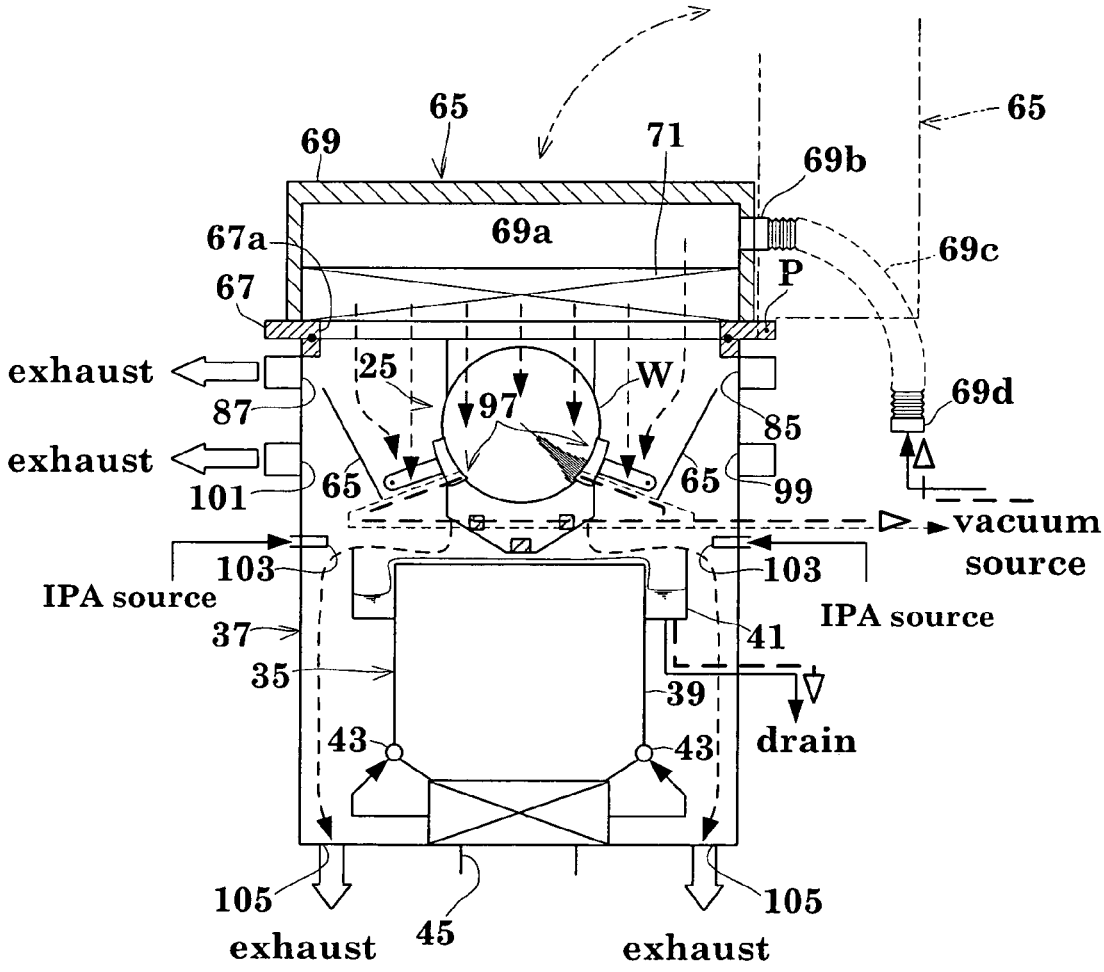
FIG. 20 is an explanatory view of operation in time of drying treatment.

Next, Embodiment 2 of this invention will be described with reference to FIGS. 19 through 21. FIG. 19 is a view in vertical section schematically showing a cleaning and drying unit in Embodiment 2. FIG. 20 is an explanatory view of operation in time of transfer and drying treatment. Parts identical to those of Embodiment 1 are shown with the same reference signs, and will not particularly be described again.

The apparatus in this embodiment includes, besides the components described hereinbefore, an intermediate chuck mechanism 97, a lateral supply nozzle 99, a lateral exhaust port 101 and IPA supply nozzles 103. However, this apparatus does not have the mechanism relating to suction of the substrate holder 57.

The intermediate chuck mechanism 97 includes a support member, engaging members, engaging grooves and suction bores similar to those of the substrate holder 57 in Embodiment 1 described above, with the suction bores similarly connected to a vacuum source. The intermediate chuck mechanism 97 is rotatable about horizontal axes P1 between a retracted position shown in solid lines and a holding position shown in two-dot chain lines in FIG. 19.

The lateral supply nozzle 99 is disposed on one side of the chamber 37 laterally of the intermediate chuck mechanism 97. The lateral exhaust port 101 is formed in the other, opposite side. The lateral supply nozzle 99 is in communication with the dry air source 75 described hereinbefore. The dry air supplied from the lateral supply nozzle 99 passes through one of the vertical deflecting plates 65 and flows toward wafers W in an intermediate position. The IPA supply nozzles 103 are in communication with an IPA source not shown, for spraying IPA (isopropyl alcohol) to areas above the treating tank 35.

The chamber 37 includes bottom exhaust ports 105 in the bottom thereof laterally of the treating tank 35. The bottom exhaust ports 105 are openable and closeable, and are used for exhausting gas mainly when dry air is supplied from the lid member 65.

The apparatus having this construction operates as follows. The cleaning treatment is the same as in Embodiment 1 described above, and will not be described. Assume that the intermediate chuck mechanism 97 is in the retracted position shown in FIG. 19.

Upon completion of cleaning treatment, the substrate holder 57 is raised from the treating position (position for performing cleaning treatment in the inner tank 39), without discharging the treating liquid from the treating tank 35, to move the wafers W to the intermediate position shown in FIG. 19. Before the upper edges of wafers W emerge from the surface of the treating liquid, the IPA supply nozzles 103 are driven to start spraying IPA. The spraying is stopped the moment the wafers W arrive in the intermediate position. As a result, the treating liquid adhering to the wafers W is replaced by IPA, to promote drying of the wafers W. In order to promote drying of IPA, it is preferable to produce a decompressed state by slowly exhausting gas from the bottom exhaust ports 105. The wafers W are now located in the position within the chamber 37 shown in FIG. 20.

When the wafers W have moved to the intermediate position, as shown in FIG. 20, the intermediate chuck mechanism 97 is operated to move to the holding position. As a result, the intermediate chuck mechanism 97 receives the wafers W in the engaging grooves thereof. As shown in FIG. 20, the substrate holder 57 descends to and stands by in a standby position slightly above the treating tank 39.

Next, the control valve 77 is opened to supply dry air from the dry air source 75 to the lid member 65, and supply the dry air to the wafers W in the intermediate position from above. At the same time, gas is exhausted from the bottom exhaust ports 105. Further, suction is applied to the intermediate chuck mechanism 97 by the vacuum source to perform drying treatment. The wafers W are dried quickly and completely by combination of the evaporating effect of the dry air supplied from the undersurface of the lid member 65, the suction effect of the intermediate chuck mechanism 97, and the effect of replacement with IPA.

In this embodiment, the replacement with IPA used in time of drying treatment is effective for suppressing menisci on the surfaces of wafers W, and promoting drying while the wafers W are raised from the treating liquid.

Upon completion of the above drying treatment, the substrate holder 57 moves up from the standby position, and receives the wafers W from the intermediate chuck mechanism 97 released from the suction. After the lid member 65 is opened, the substrate holder 57 moves to the upper, non-treating position.

The above drying treatment may be performed as follows.

Figure 21:
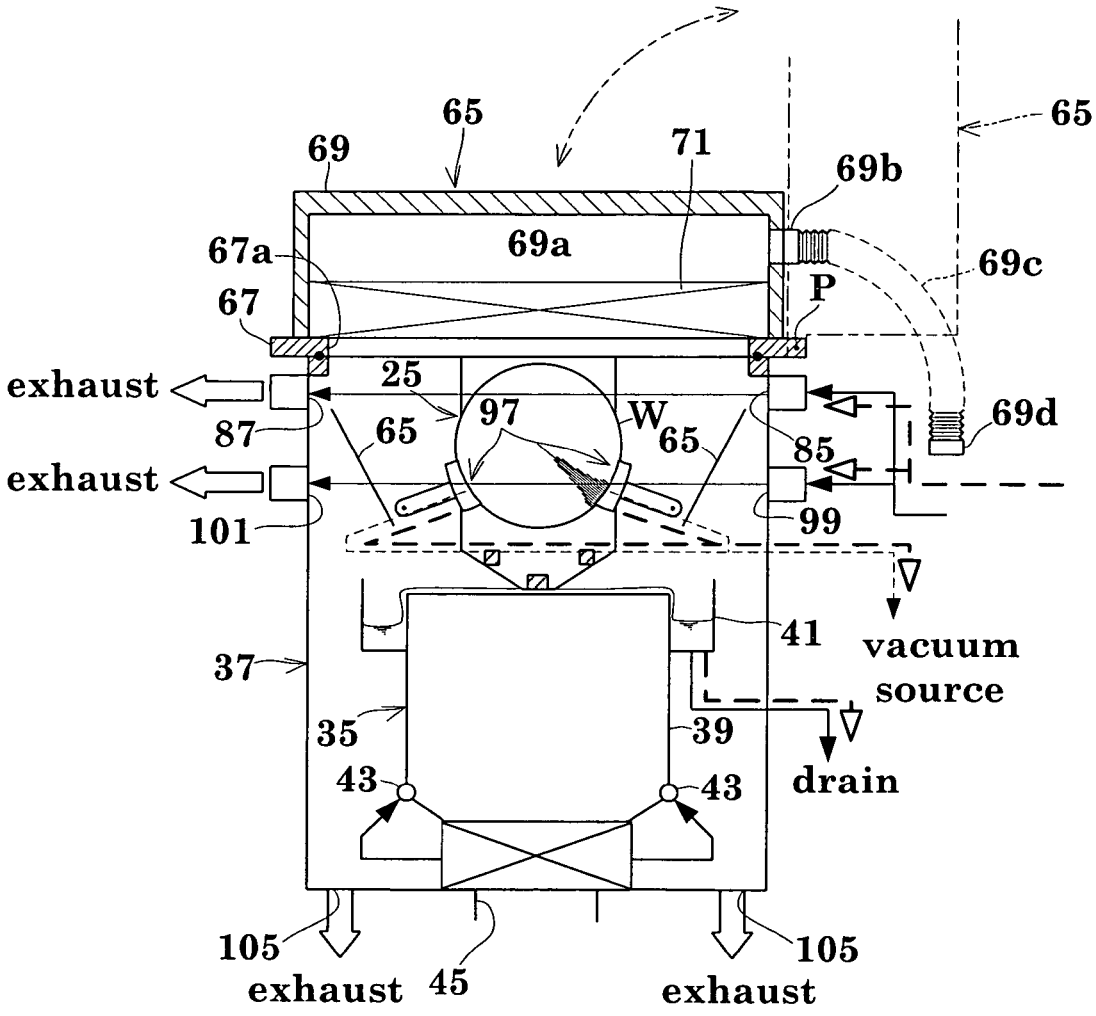
FIG. 21 is an explanatory view of operation in time of the drying treatment.

As shown in FIG. 21, until the wafers W move to the intermediate position or after this movement, the control valve 89 is opened with the control valve 77 remaining closed, to supply the dry air into the chamber 37 only from the supply port 85 and lateral supply nozzle 99. Thus, the dry air is supplied sideways to the wafers W emerging from the treating liquid surface and moving to the intermediate position, or having arrived in the intermediate position, thereby laterally performing drying treatment.

The dry air supply from the lid member 65 and the dry air supply from the supply port 85 and lateral supply nozzle 99 may be carried out alternately.

In Embodiment 2, after the cleaning treatment in the treating tank 35, the wafers W are transferred to the intermediate chuck mechanism 97 above the treating tank 35. In time of the transfer, some of large droplets adhering to the edges of wafers W can fall off. This provides an advantage over Embodiment 1 in that the subsequent drying treatment may be performed smoothly.

The lateral supply nozzle 99 may be disposed lower than the position shown in FIG. 21, to supply dry air to the wafers W being transported above the liquid surface in the treating tank 35.

This invention is not limited to the above embodiments, but may be modified as follows:

(1) The air in the cleanroom is used as drying gas in the described embodiments. An inert drying gas (e.g. nitrogen gas) may be used instead.

(2) Where the construction is free from generation of particles in time of opening and closing the lid member 65, or where particles generated in time of opening and closing the lid member 65 impart no influence, there is no need to provide the device for forming an air curtain.

(3) Where a clean gas can be supplied from the lid member 65, there is no need to provide the filter 71 for the lid member 65.

(4) A device may be provided for supplying electrolytic water into the inner tank 39 before withdrawing the wafers W up from the treating liquid, to suppress silicon dissolving from the wafers W.

This invention may be embodied in other specific forms without departing from the spirit or essential attributes thereof and, accordingly, reference should be made to the appended claims, rather than to the foregoing specification, as indicating the scope of the invention.

What is claimed is:

1. A substrate cleaning and drying apparatus for performing drying treatment after cleaning treatment of substrates, comprising:

a treating tank for storing a treating liquid, and performing the cleaning treatment of the substrates immersed in the treating liquid;

a treating chamber housing said treating tank, and having an opening formed in an upper position of the treating chamber for allowing passage of the substrates into and out of the treating chamber;

a lid member movable to open and close said opening of said treating chamber; and holding device for holding the substrates within said treating tank, said holding device having suction bores;

wherein, after the cleaning treatment of the substrates with the treating liquid in said treating tank, a gas is supplied toward the substrates, with said lid member closed, while suction is effected through said suction bores of said holding device.

2. An apparatus as defined in claim 1, further comprising discharge device for discharging the treating liquid from said treating tank, wherein, after the treating liquid is discharged from said treating tank by said discharge device, the gas is supplied toward the substrates, with said lid member closed, while suction is effected through said suction bores of said holding device.

3. An apparatus as defined in claim 1, wherein said holding device is movable between a position in said treating tank and a position in said treating chamber above said treating tank, and wherein, after the cleaning treatment of the substrates with the treating liquid in said treating tank, said holding device is moved from the position in said treating tank to the position in said treating chamber above said treating tank, and the gas is supplied toward the substrates, with said lid member closed, while suction is effected through said suction bores of said holding device.

4. An apparatus as defined in claim 3, further comprising supply device for supplying the gas, in a position above a liquid surface in said treating tank, to the substrates having moved from the position in said treating tank to the position in said treating chamber above said treating tank.

5. An apparatus as defined in claim 1, further comprising gas supply device disposed laterally of said treating chamber above said treating tank for supplying the gas into said treating chamber.

6. An apparatus as defined in claim 5, wherein said gas supply device is arranged to supply dry air.

7. An apparatus as defined in claim 1, further comprising first supply device provided for said lid member for supplying the gas toward the substrates, and second supply device disposed laterally of said treating chamber above said treating tank for supplying the gas into said treating chamber.

8. An apparatus as defined in claim 1, further comprising organic solvent supply device for supplying an organic solvent into said treating chamber after the cleaning treatment of the substrates with the treating liquid in said treating tank.

9. An apparatus as defined in claim 8, wherein said organic solvent supply device is disposed laterally of said treating chamber above said treating tank.

* * * * *